US006684582B2

(12) United States Patent
Peart et al.

(10) Patent No.: US 6,684,582 B2
(45) Date of Patent: Feb. 3, 2004

(54) MODULAR FLOOR TILES AND FLOOR SYSTEM

(75) Inventors: Stephen Peart, Campbell, CA (US); Ross Lovegrove, London (GB); Robert W. Insalaco, Holland, MI (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 10/012,572

(22) Filed: Nov. 5, 2001

(65) Prior Publication Data

US 2002/0157331 A1 Oct. 31, 2002

Related U.S. Application Data

(63) Continuation of application No. 09/724,673, filed as application No. PCT/US99/11966 on Jun. 1, 1999.

(60) Provisional application No. 60/087,582, filed on Jun. 1, 1998.

(51) Int. Cl.[7] ..... E04C 2/52

(52) U.S. Cl. ..... 52/220.1; 52/220 S; 52/263

(58) Field of Search ..... 52/220.1, 220.8, 52/263

(56) References Cited

U.S. PATENT DOCUMENTS

| | | | | | |
|---|---|---|---|---|---|
| 5,400,554 | A | * | 3/1995 | Lo | 52/126.5 |
| 5,904,015 | A | * | 5/1999 | Chen | 52/220.2 |
| 6,370,831 | B1 | * | 4/2002 | Marshall et al. | 52/263 |
| 6,455,773 | B2 | * | 9/2002 | Bellanger | 174/50 |

* cited by examiner

*Primary Examiner*—Carl D. Friedman
*Assistant Examiner*—Steve M Varner
(74) *Attorney, Agent, or Firm*—Brinks Hofer Gilson & Lione

(57) ABSTRACT

A modular tile and modular tile system is disclosed. The modular tile includes a base structure having a generally horizontal portion. Floor support members are positioned on a bottom surface of the generally horizontal portion. Upper column members extend above the horizontal portion of the modular tile. A cover is supported by the upper column members a distance above the horizontal portion thereby creating a chamber between the horizontal portion and the cover. The chamber is adapted to receive cabling therein.

20 Claims, 28 Drawing Sheets

95
679
601
621
624
623
622
626
675
575
625
628
708
679
682
681
631
680
301
501
900
401
702
800
585
663
847
810
910
679
645
120
140
849
845
641
649
775
775
661
749
665
910
910
659
790
745
790
910
643
651
851
659
790
667
775
671
32

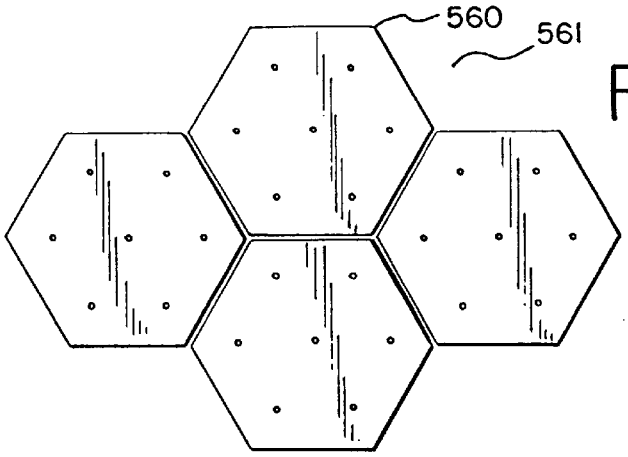
FIG. 36
FIG. 38
FIG. 37
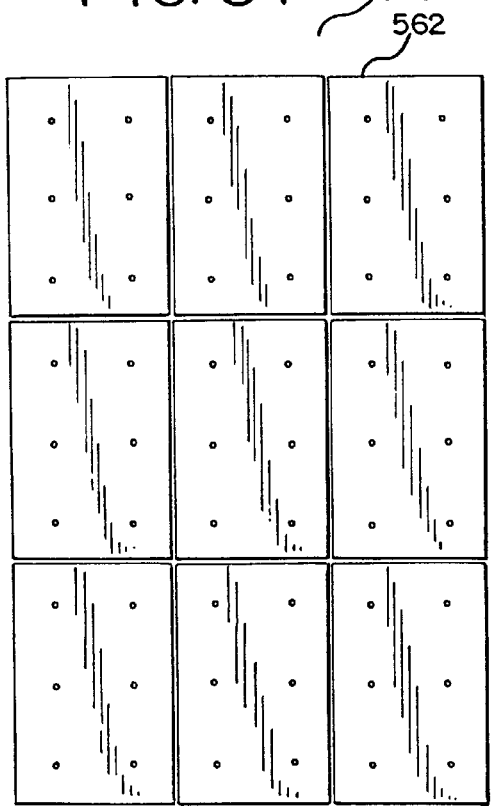
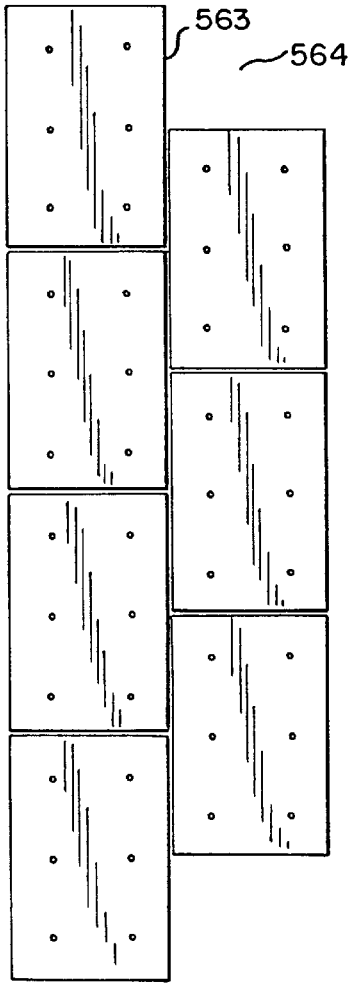

MODULAR FLOOR TILES AND FLOOR SYSTEM

RELATED APPLICATION

This application is a continuation of application Ser. No. 09/724,673, filed Nov. 28, 2000, (pending), which is hereby incorporated by reference herein.

Pursuant to 35 U.S.C. § 119(*e*) and §365, this application claims the benefit of the filing date of PCT Application No. PCT/US99/11966, filed Jun. 1, 1999, which claimed the benefit of U.S. Provisional Application Serial No. 60/087,582, filed Jun. 1, 1998, the disclosure of which is hereby incorporated by reference.

BACKGROUND OF THE INVENTION

The present invention relates generally to a modular tile and modular tile system. More specifically, it relates to a modular tile and modular tile system installed on an existing floor.

Work environments are becoming increasingly sophisticated due to an increasing need for utilities necessary to service the environment including power, data and communications networks. Often, these environments must distribute power to tools such as computers, printers and the like. In addition, many environments must distribute data and communications cabling to support interoffice electronic mail, world-wide internet connectivity, and in-house intranet connectivity. An important consequence of this increased sophistication in work environments is the increased need for distributing and managing cabling in an efficient, safe and aesthetically appealing manner.

Another demand often placed on modern work environments is the need to be easily configured and reconfigured to keep in stride with the fluctuating demands and influences in the work place.

One solution to providing increased volumes of power and data cabling throughout an office environment is to create a raised floor, namely a floor built a distance above the existing floor to thereby provide a space for cabling between the two. Some raised floors are architectural, i.e. are installed when the building is built, and include a series of relatively large panels, some of which can be lifted to gain access to the space. Other raised floor systems are installed later and comprise a gridwork of supports and panels or tiles which are installed over this gridwork. An example of such a pieced-together system is shown in U.S. Pat. No. 4,593,499 to Kobayashi et al.

Typically, both types of raised floors, namely the architectural and the pieced-together, are installed by skilled tradespersons having special tools, equipment and training. Naturally, providing adequate support and proper leveling are important concerns. As a consequence, the installation and/or reconfiguration of the conventional raised floor is often costly. Moreover, work environment elements can not be easily configured and reconfigured with the typical raised floor.

Also, because raised floors are most often installed in a wall-to-wall configuration, a facilities planner must commit to equipping the entire work space with a raised floor, rather than equipping only that portion with the requirements justifying a raised floor. This fact reduces the utility and adaptability of raised floors to certain work environments, especially those that have a need to equip some work stations one way for some of its workers and some another way for others of its workers. In particular, it would be desirable in some work environments to create platforms of a raised floor to meet the needs within that part of the work environment.

The conventional raised floor often lacks specific cabling management capabilities. For example, in some systems, the cabling is not isolated from one another nor managed separately within the floor. This can create interference and noise problems between power, communication, and data cabling.

SUMMARY OF THE INVENTION

Briefly stated, the present invention is directed to a modular tile and modular tile system.

A modular tile and modular tile system is disclosed. The modular tile includes a base structure having a generally horizontal portion. Floor support members are positioned on a bottom surface of the generally horizontal portion. Upper column members extends above the horizontal portion of the modular tile. A cover is supported by the upper column members a distance above the horizontal portion thereby creating a chamber between the horizontal portion and the cover. The chamber is adapted to receive cabling therein.

The preferred present invention is modular in that it is configurable and can be quickly connected and re-connected.

The modular tile platform environment can provide related economic benefits. For example, in certain types of lease situations, the modular tiles can provide a tenant improvement and therefore specific leasehold advantages. The tiles can also be quickly reconfigured for a new tenant. Moreover, such a tile scheme is usually easily transported by the tenant for rapid deployment in the next installation. With its on-site capacity and ability to support the frequent transitions associated with temporary or visiting work environments, the modular environment can enhance the benefits of rental and lease opportunities.

BRIEF DESCRIPTION OF THE DRAWINGS

FIG. 36 is a top view of a modular tile platform incorporating another alternative embodiment of the present invention.

FIG. 37 is a top view of the modular tile platform incorporating another alternative embodiment of the present invention.

FIG. 38 is a top view of the modular tile platform incorporating another alternative embodiment of the present invention.

DETAILED DESCRIPTION OF THE PREFERRED EMBODIMENTS

Figure 1:
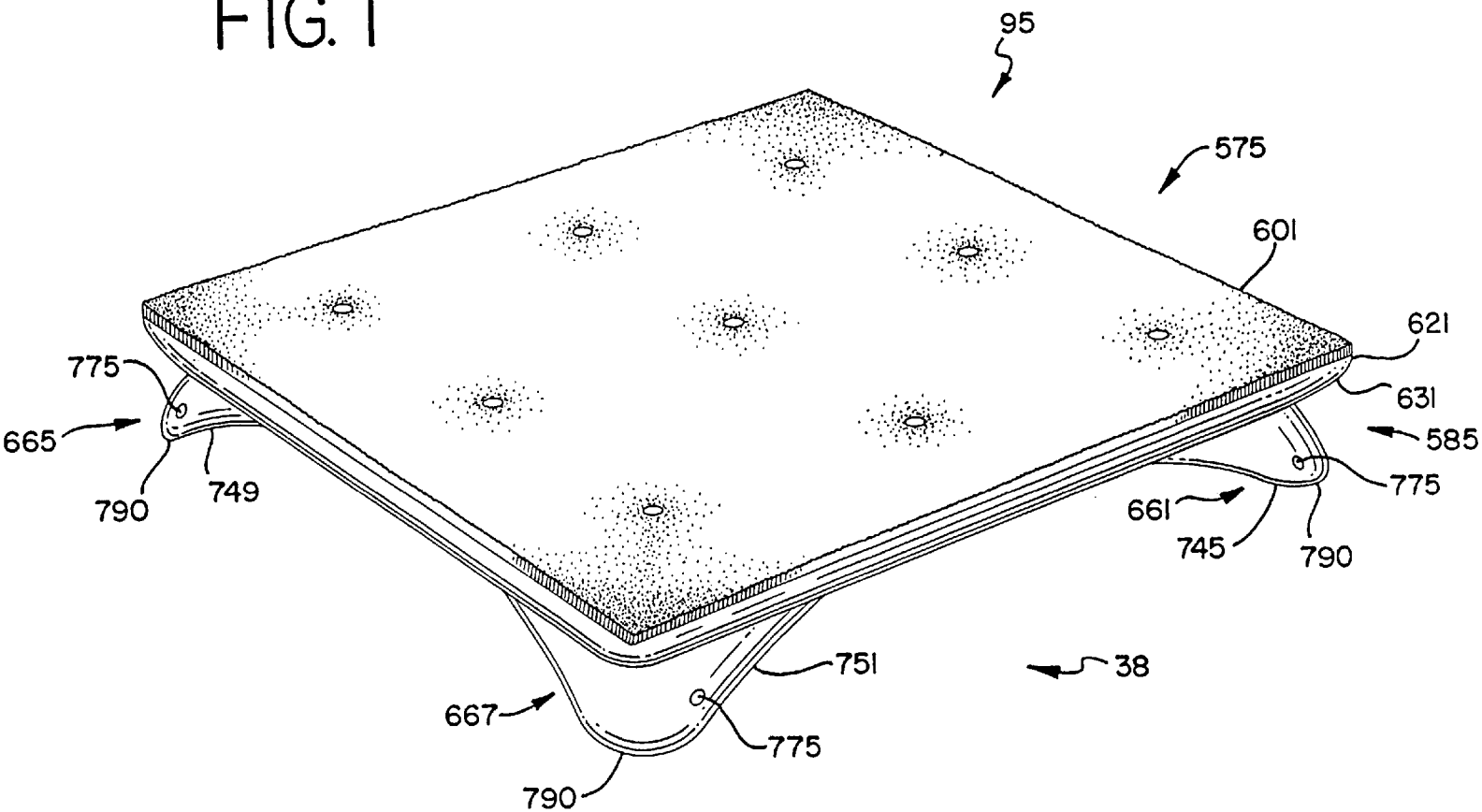
FIG. 1 is a perspective view of a modular tile according to the preferred embodiment of the present invention.
Figure 2:
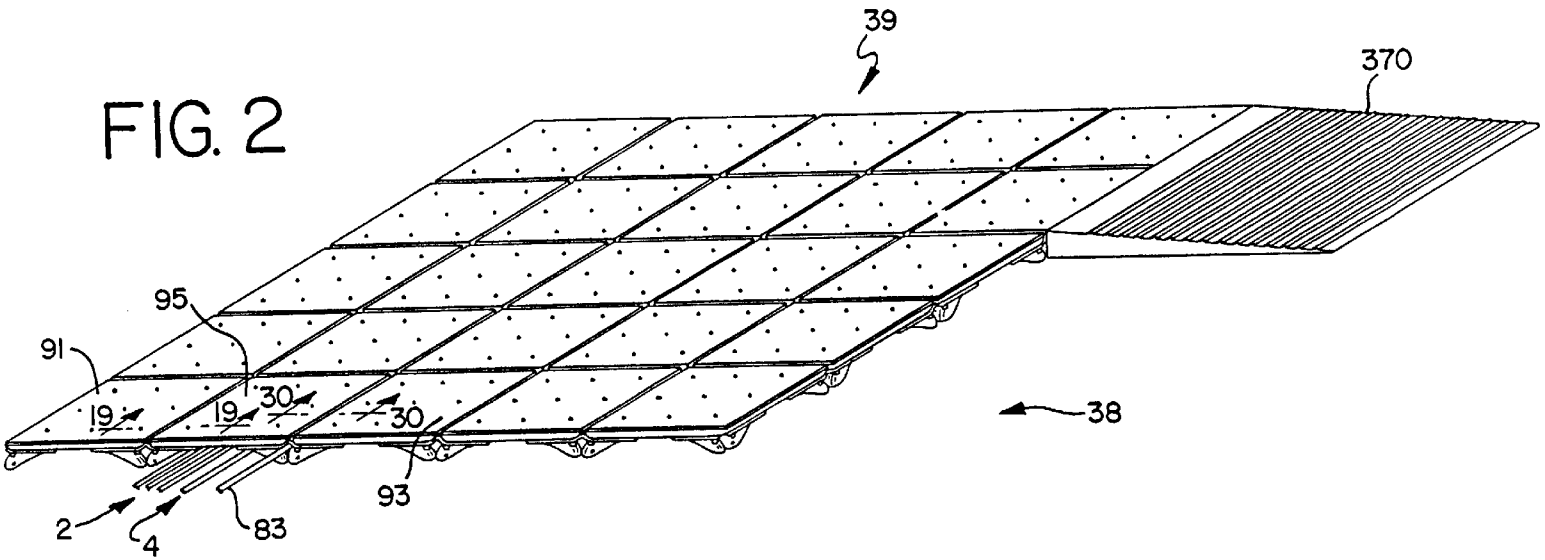
FIG. 2 is a perspective view of a modular tile platform incorporating the modular tile shown in FIG. 1.
Figure 3:
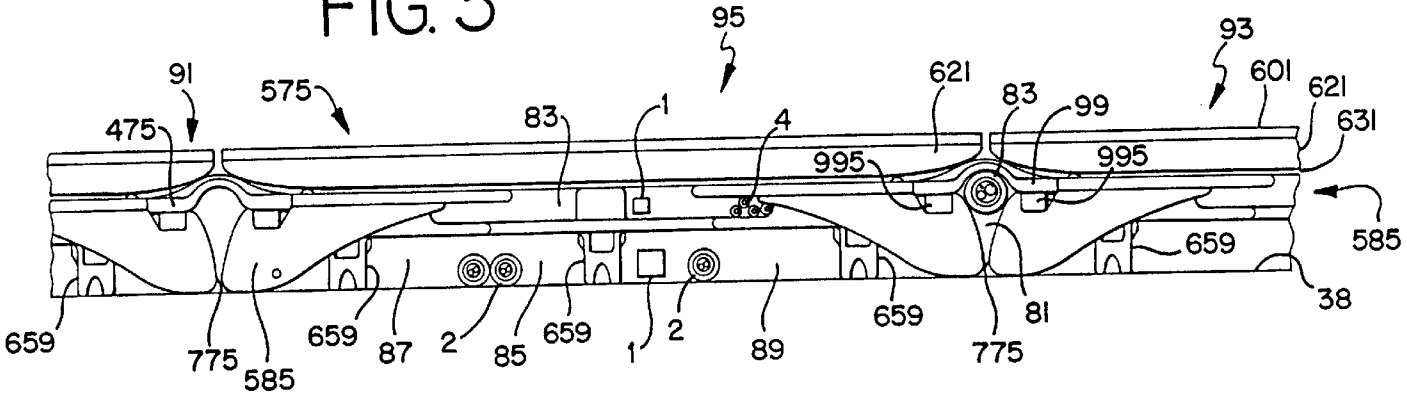
FIG. 3 is a partial side view of the modular tile platform shown in FIG. 2.
Figure 4:
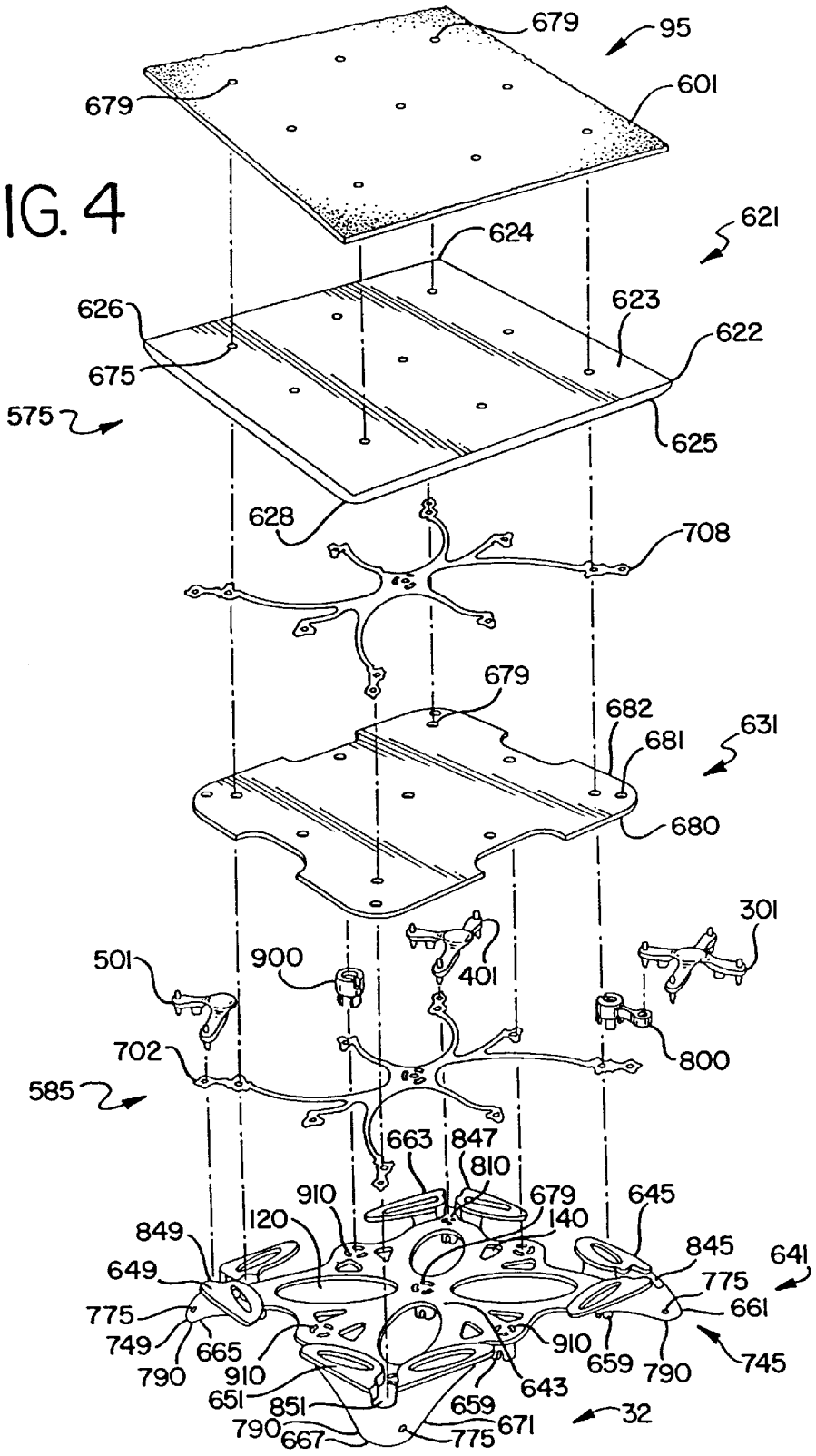
FIG. 4 is an exploded perspective view of one of the modular tiles shown in FIG. 3.

Referring to the drawings, FIG. 1 is a perspective view of a modular tile 95 incorporating the preferred embodiment of the present invention. Modular tile 95 is preferably exposed along its edges and installed on top of an existing floor 38. FIG. 2 is a perspective view of a modular tile platform 39 configured using the modular tile shown in FIG. 1. Modular tile platform 39 is preferably exposed along its outer edges. Alternatively, a ramp 370 or platform trim 375 is provided along the edges of the modular tile platform. FIG. 3 is a partial side view of the modular tile platform shown in FIG. 2. FIG. 3 shows the modular tile 95 connected to two modular tiles 91, 93. FIG. 4 is an exploded view of modular tile 95 shown in FIGS. 1–3.

Referring to FIGS. 1–4, modular tile 95 preferably comprises a square top portion 575 and a square bottom portion 585. The general dimensions of the preferred modular tile is 18 inches in width and 18 inches in height. Top portion 575 comprises an insulating member 631, cover 621 and floor covering 601. Bottom portion 585 comprises a base structure 641, tile connects 301, 401 or 501, corner members 800 and horizontal portion members 900. These elements can be more clearly described with reference to FIGS. 3 and 4.

FIG. 3 shows a complete side view of modular tile 95 and a partial side view of modular tiles 91 and 93. Modular tiles 91 and 93 are generally of similar structure as modular tile 95. Modular tile 95 is connected to modular tile 91 and modular tile 93 via modular tile connect 475 and 99, respectively. Also shown is cabling 2, and 4. Cabling 2, 4 can be efficiently installed underneath the modular tile 95 since the tile 95 is preferably exposed along each of its edges. In this preferred embodiment, cabling 2 provides power and cabling 4 provides communications.

Base portion 585 is installed on top of existing floor 38 and defines a lower chamber 85. Top portion 575 resides on bottom portion 585, thereby defining an upper chamber 75. Both chambers 75 and 79 are adapted to receive cabling, electrical devices 1 and the like. Electrical devices 1 receivable in either chamber 75 or 79 include transformers, junction boxes, outlet boxes, wiring harnesses and other like electrical devices. Preferably, lower chamber 85 defines two channels 87, 89 and upper chamber 83 defines two channels 74, 75. Power cabling 2 is installed in channels 85, 89 and communications cabling 4 is installed in channel 75.

Alternatively, as shown in FIG. 3, cabling 83 is managed between two connected modular tiles 95, 93 and underneath modular tile connect 99.

Separating the power cabling 2 from the communications cabling 4 results in a number of advantages. For example, separation provides an easier method of troubleshooting if utilities maintenance is required. It also minimizes the risk of electrical interference. Moreover, installing the higher voltage cabling 2 in lower chamber 85 reduces the risk of electrical exposure to occupants of the work environment.

Figure 5:
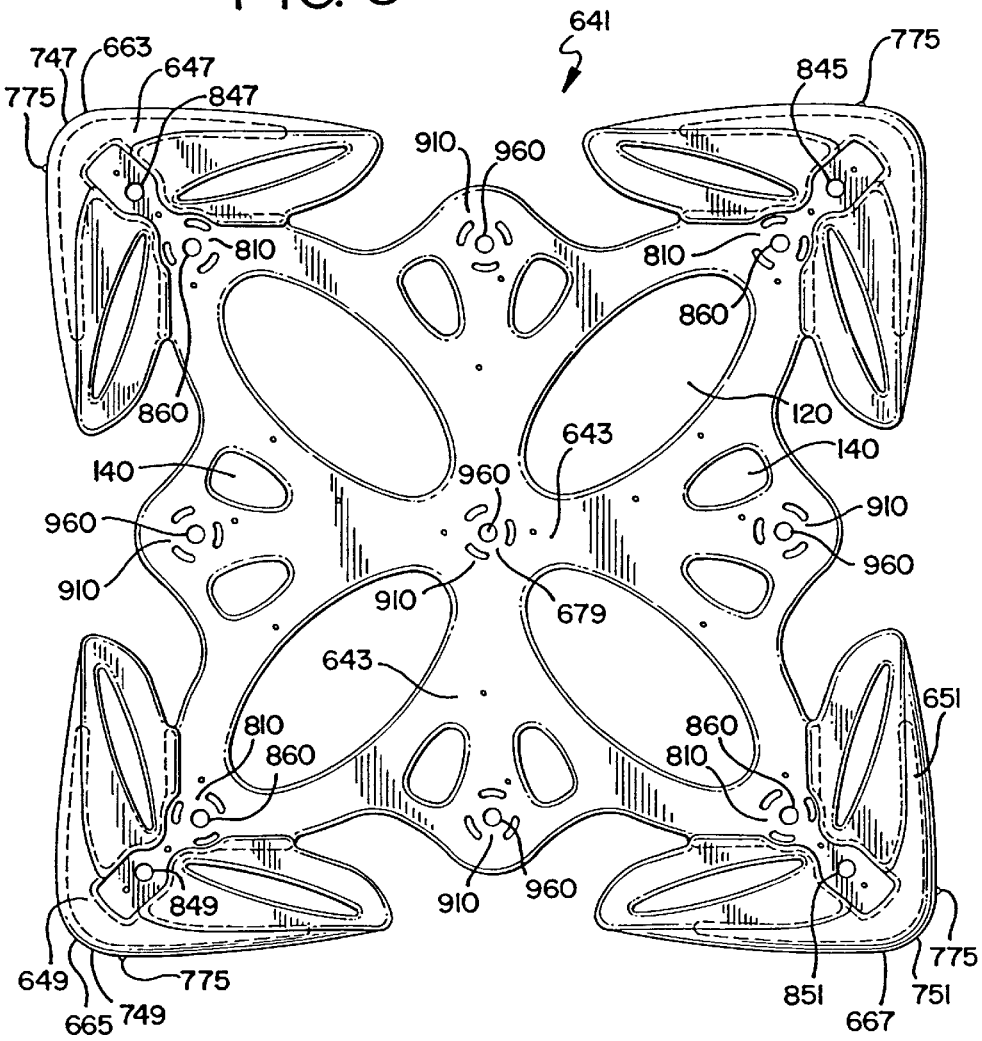
FIG. 5 is a top view of the base structure shown in FIG. 4

FIG. 4 is an exploded view of the modular tile 95 shown in FIGS. 1–3. Preferably, base portion 585 includes a generally rectangular base structure 641 having a generally horizontal portion 643. FIG. 5 is a top view of base structure 641. Preferably, horizontal portion 643 has various sets of holes, upper column members, and support legs.

Referring to FIGS. 3, 4, and 5, horizontal portion 643 has a first set of holes 120, a second set of holes 140, a third set of holes 910 and a fourth set of holes 810. These sets of holes serve a number of beneficial purposes. For example, using holes 120, cabling installed on top of or beneath horizontal portion 643 can be secured using a cable tie (not shown). Holes 120 also allow cabling installed in either upper chamber 75 or lower chamber 85 of the assembled tile 95 to be accessed and pulled through horizontal portion 643. Therefore, installed cabling can be managed in both upper and lower chambers 75 and 85 within one modular tile and can be re-installed or re-managed without having to re-install the entire base structure 641.

Holes 120 also decrease the amount of material required for the base structure 641, thereby reducing manufacturing costs. The resulting modular tile 95 is also lighter and easier to manipulate and install. Holes 120 also increase the flexibility of base structure 641 so that it can conform to surface inconsistencies in the existing floor. Preferably, horizontal portion 643 comprises a second set of holes 140. Holes 140 provide similar advantages as holes 120.

Preferably, as shown in FIGS. 4 and 5, horizontal portion 643 has a third set of holes 910 and a fourth set of holes 810. Third set of holes 910 are adapted to cooperate with horizontal portion members 900. Fourth set of holes 810 are adapted to cooperate with corner members 800.

Preferably, the four corners 661, 663, 665 and 667 of base structure 641 are integral with the four upper column members 645, 647, 649 and 651. Alternatively, upper column members 645, 647, 649 and 651 are integral with top portion 575. Upper column members 645, 647, 649 and 651 extend vertically above a plane defined by horizontal portion 643 and are positioned at the corners of the base structure 641.

Four upper column members 645, 647, 649 and 651 define an upper chamber on the upper surface of base structure 641. Top portion 575 resides on these four upper column members. In an alternative embodiment, more than four upper column members support top portion 575. Additional upper column members provide a number of advantages. First, they further partition the upper chamber thereby defining channels for installing and managing cabling and other electrical devices. They also increase the rigidity and strength of the modular tile 95.

Preferably, the additional upper column members comprise both horizontal portion members 900 and corner members 800. Third set of holes 910 are adapted to releasably affix the horizontal portion members 900 to the horizontal portion 643. Base structure 641 has five horizontal portion members 900 (only one shown in FIG. 4). Preferably, one horizontal portion member 900 is positioned at the center 679 of horizontal portion 643. The other four are spaced between two adjacent upper column members 645, 647, 649 and 651.

Preferably, member 900 resides on horizontal portion 643 and extends vertically above horizontal portion 643 to the same relative height as the upper column members 645, 647, 649 and 651. In modular tile 95, surface 680 of insulation member 631 resides on member 900. In this preferred embodiment, member 900 provides additional support to modular tile 95 thereby increasing modular tile stability and rigidity.

Figure 16:
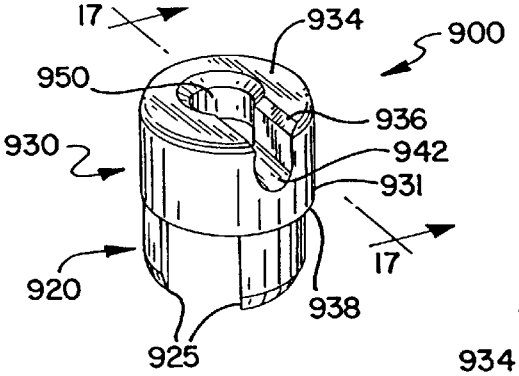
FIG. 16 is a perspective view of a horizontal portion member shown in FIG. 4.
Figure 17:
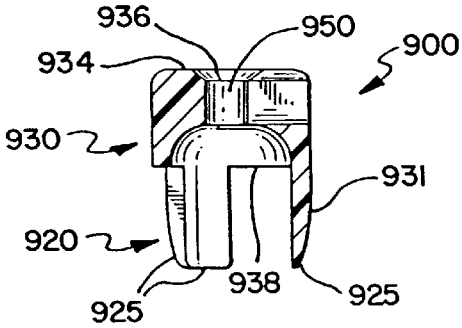
FIG. 17 is a sectional side view of the horizontal member taken along the line 17—17 of FIG. 16.

FIG. 16 provides a perspective view of a preferred embodiment of horizontal portion member 900. FIG. 17 is a sectional side view of the horizontal portion member 900 taken along the line 17—17 shown in FIG. 16. Referring to FIGS. 16 and 17, horizontal portion member 900 comprises a bottom portion 920 and a top portion 930.

Bottom portion 920 comprises a plurality of securing means for securing member 900 to base structure 643. Bottom portion 920 comprises securing tabs 925 positioned in a generally cylindrical fashion. In the preferred embodiment, three tabs 925 cooperate with three holes 910 of horizontal portion 641. Alternatively, more than three securing tabs 925 are provided. Tabs 625 prevent an installed member 900 from rotating.

Top portion 930 comprises a generally cylindrical shaped member having a top surface 934, a bottom surface 938, an outer surface 931 and an aperture 950. Aperture 950 extends from top surface 934 to bottom surface 938 and is adapted to receive a protruding portion of an indexing element associated with a work environment element. Preferably, aperture 950 is provided with a bevel 936 at top surface 934 such that the protruding portion can be easily adapted within aperture 950.

Upper member 930 comprises a channel 942 extending from aperture 950 to exterior surface 931 of upper portion 930. Channel 942 prevents an installed protruding portion from turning or rotating. Preferably, member 900 is a unitary device comprising the same type of material as base structure 643 and connect members 301, 401 and 501. Alternatively, member 900 is integral with the base structure 643.

As previously mentioned, base structure 641 comprises a fourth set of holes 810 adapted to cooperate with corner members 800. As shown in FIGS. 4 and 5, member 800 cooperates with holes 810 at the four corners of horizontal portion 643. Preferably, member 800 extends vertically above the horizontal portion 643 to the same relative height as the upper column members 645, 647, 649 and 651. Once disposed on horizontal portion 643, member 800 cooperates with bottom surface 680 of insulation member 631 beneath corners 622, 624, 626 and 628 of cover 621. In this preferred embodiment, member 800 provides additional support to modular tile 95 thereby increasing its stability and rigidity.

Figure 14:
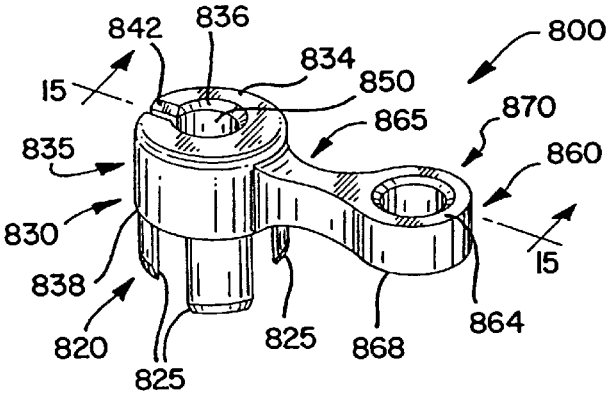
FIG. 14 is a perspective view of a corner member shown in FIG. 4.
Figure 15:
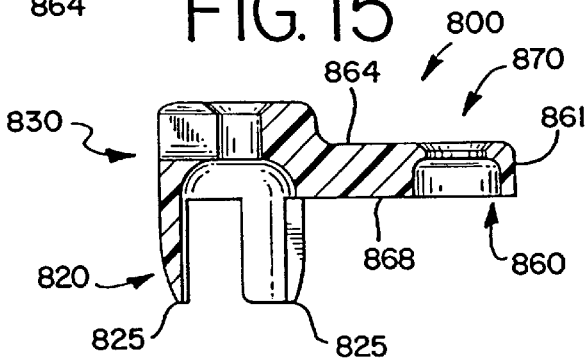
FIG. 15 is a sectional side view of the corner member taken along the line 15—15 of FIG. 14.

FIG. 14 provides a perspective view of a preferred embodiment of corner member 800. FIG. 15 is a sectional side view of member 800 taken along the line 15—15 as shown in FIG. 14. Referring to FIGS. 14 and 15, corner member 800 comprises a bottom portion 820 and a top portion 830. Bottom portion 820 comprises a plurality of securing means for securing member 800 to base structure 641. Bottom portion 820 comprises securing tabs 825 oriented in a generally cylindrical fashion around bottom portion 820. In the preferred embodiment, three tabs 825 cooperate with three holes 810 of horizontal portion 641.

Alternatively, more than three securing tabs 825 are provided. Securing tabs 825 prevent an installed member 800 from rotating.

Top portion 830 comprises a generally cylindrical shaped member 835 having a top surface 834, a bottom surface 838, an outer surface 831, an aperture 850, and a connecting member 860.

Aperture 850 extends from top surface 834 to bottom surface 838 and is adapted to receive a protruding portion of an indexing element associated with a work environment element. Preferably, aperture 850 is provided with a bevel 836 at top surface 834 such that the protruding portion can be more easily adapted.

Upper member 830 comprises a channel 842 extending horizontally from aperture 850 to exterior surface 831. Preferably, channel 842 extends horizontally from aperture 850 opposite connecting member 860. Channel 842 prevents installed indexing elements from turning or rotating.

Connecting column member 860 extends outwardly from top portion 830 and comprises a first portion 865 and a second portion 870. First portion 865 extends from column member 800 first portion 830. Second portion 870 comprises a top surface 864, a bottom surface 868, an outer surface 861, and an aperture 870. Aperture 870 extends from top surface 864 to bottom surface 868. Preferably, aperture 870 is adapted to receive a connecting pin from either a two-way 301, three-way 401 or four-way tile connect 501.

Preferably, member 800 is a unitary device and is made from the same material as base structure 643 and connect members 301, 401 and 501. Alternatively, the member 800 is integral with the base structure 641.

Returning to FIG. 4, base structure 641 further comprises at least four support legs 745, 747, 749 and 751 which preferably support an individual modular tile 95. Alternatively, the support legs support more than one modular tile. For example, a support leg may be a unitary device positioned at a common point where two or more modular tiles meet. At this common point, one leg would support a corner of each of the modular tiles.

Support legs 745, 747, 749 and 751 are preferably integral with base structure 641. Preferably, upper column members 645, 647, 649 and 651 are integral with support legs 745, 747, 749 and 751, respectively. In a more preferred embodiment, support legs 745, 747, 749 and 751, and upper column members 645, 647, 649 and 651 are integral with base structure 641. Most preferably, base structure 641, support legs 745, 747, 749 and 751 and upper column members 645, 647, 649 and 651 are made in one piece.

A spacing member 775 is disposed on each leg 745, 747, 749 and 751 and protrudes laterally away from the surface of the leg. Spacing member 775 cooperates with the support legs on adjacent modular tiles such that the legs are positioned a predetermined distance from one another. For example, as is shown in FIG. 3, the support legs of connected modular tiles 91, 95 and 95, 93 are positioned a predetermined distance from one another by spacing members 775. Spacing member 775 is preferably made from the same piece of material as the legs 745, 747, 749 and 751. Alternatively, a spacing member is a different piece of material which is rigidly affixed to the leg.

Spacing member 775 provides a number of advantages. For example, in the preferred embodiment, by spacing side by side connected modular tiles a predetermine distance from one another, installation will usually require less labor. In addition, because installed modular tiles only touch one another at the spacing member rather than along an entire edge of the modular tile, a modular tile can oftentimes be taken out of an assembled platform without having to disconnect and/or remove other connected modular tiles. Furthermore, by spacing the modular tiles a constant, predetermined distance from one another, a heightened aesthetic appearance of a connected modular tile platform can be achieved.

Figure 30:
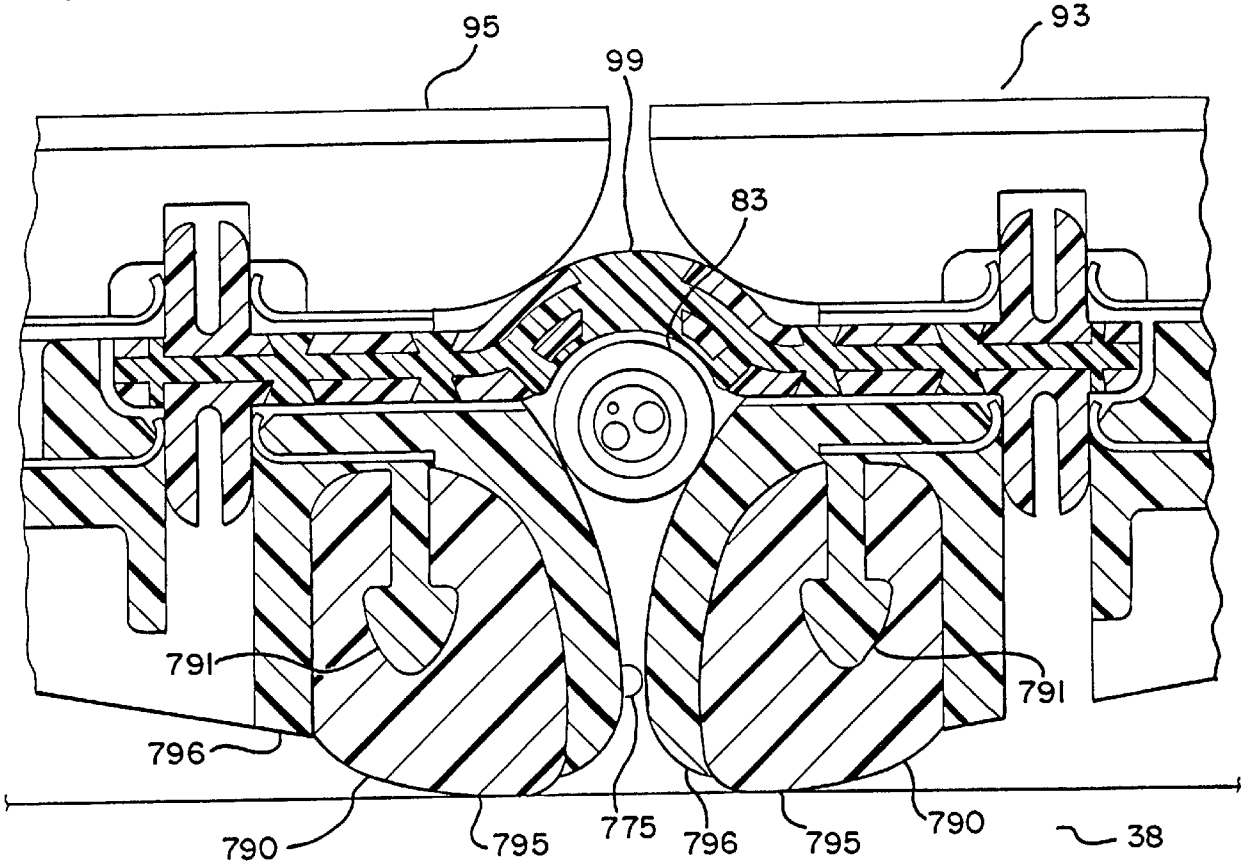
FIG. 30 is a partial sectional side view of a modular tile platform similar to the platform shown in FIG. 19 and including a leveling member disposed on the support legs of the modular tiles.

In an alternative embodiment, support legs 745, 747, 749 and 751 comprise a leveling member 790. FIG. 30 is a partial sectional side view of a modular tile platform similar to the platform shown in FIG. 19 and includes a leveling member disposed on the support legs of the modular tiles. FIG. 30 shows two modular tiles 91, 95 connected to one another via a modular tile connect 99. Modular tiles 91, 95 are installed over existing floor 38. Modular tiles 91, 95 have support legs 795. Preferably, support legs 795 comprise an outer shell 796 and a retaining member 791. The retaining member 791 retains the leveling member 790 within the support leg 795.

Preferably, leveling member 790 is a slow reaction member which absorbs uneven surfaces on existing floor 38. The leveling member preferably includes a sack made of a flexible, preferably non-elastic polymer such as a thermoplastic polyurethane compound or the like. The sack is filled with a viscous material, such as a gel, which flows quite slowly. Alternatively, the sack can be filled with particulate matter which shifts and flows under pressure. Suitable gel materials include modified thermoplastics. An example of a gel that may be used in a preferred embodiment includes KRAFTON from Shell Chemical Co.

In still another alternative embodiment, the leveling member comprises a thermoplastic material which is designed to be relatively non-flowing at room temperature, but which will flow when subjected to heat. The thermoplastic material is provided either in a sack or exposed directly to the existing floor. This alternative embodiment looks similar to the embodiment shown in FIG. 30. In this alternative embodiment, the installer can heat the leveling devices, for example with a hot air gun, just before placing on the floor. Upon cooling, the leveling device maintains its shape. If, at some point after installation, the floor needs to be leveled again, the appropriate modular tiles can be lifted, heated and reinstalled.

Referring to FIGS. 3 and 4, base structure 641 comprises lower column members 659 which extend vertically below the horizontal portion 643. Lower column members 659 are disposed on lower surface of horizontal portion 643 and further partition lower chamber 79 into channels between the existing floor 32 and base structure 641. Preferably, lower column members also increase the rigidity and strength of modular tile 95.

Preferably, base structure 641 comprises nine lower column members 659. Lower column members 659 are integral with base structure 641 and are located beneath holes 810, 910 and support each corner member 800 and horizontal portion member 900. More preferably, lower column members 659 and corner member aperture 850 together define an aperture 860 adapted to receive a protruding portion of an indexing element associated with a work environment element. In addition, lower column members 659 and horizontal portion members 900 together define an aperture 960 adapted to receive a protruding portion of an indexing element associated with a work environment element.

As shown in FIG. 5, base structure 641 further comprises four connecting points 845, 847, 849 and 851 located at the corners 661, 663, 665, and 667 of base structure 641, respectively. Each connecting point is positioned adjacent hole 810 and aperture 860 to cooperate with a modular tile connect 301, 401 or 501 to facilitate connecting adjacent modular tiles.

Preferably, base structure 641 is an injection molded device utilizing recycled polypropylene. More preferably, the recycled polypropylene is approximately thirty percent glass fill. Flame retardants and smoke suppressants are preferably added to the recycled polypropylene. An example of a polypropylene that may be used in a preferred embodiment includes VERTON from LNP Engineering Plastics, Inc. The preferred polypropylene is an approximately 50 percent long glass fiber composite.

Polypropylene is the preferred material for the base structure since it can generally conform to deviations in an existing floor. In another preferred embodiment, base structure 641 is a diecasting of associated alloys and/or composites which generally increases the base structure rigidity and overall modular tile stability.

Returning to FIG. 4, top portion 575 comprises a floor covering 601, a cover 621 and an insulator 631. In the preferred embodiment, top portion 575 further comprises a generally horizontal conductor 708 disposed between the cover 621 and insulator 631. Cover 621 is essentially the same shape as bottom portion 585. Preferably, cover 621 is square with corners 622, 624, 626 and 628. Alternatively, cover 621 is hexagonal or trapezoidal.

Cover 621 is preferably fabricated from a molded density fiberboard (MDF). MDF is the preferred material because it is rigid and relatively lightweight, therefore allowing the cover 621 to be lifted by hand.

Figure 6:
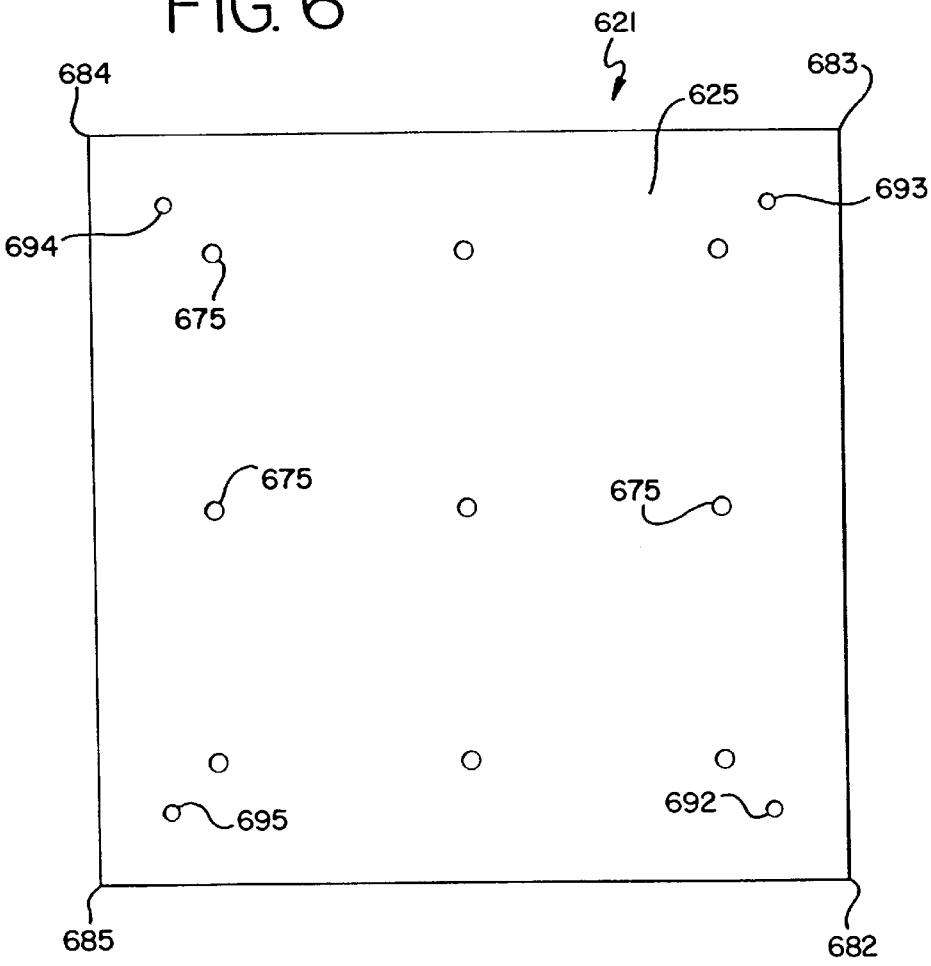
FIG. 6 is a bottom view of the modular tile cover shown in FIG. 4.
Figure 7:
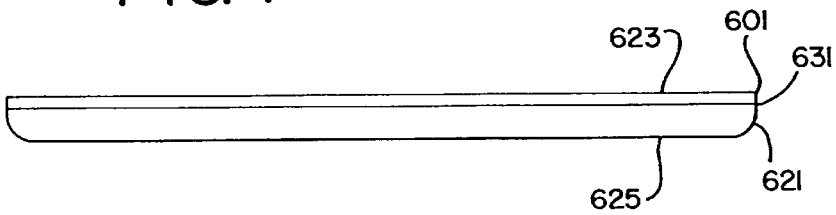
FIG. 7 is a side view of the cover shown in FIG. 6.

FIG. 6 is a bottom view of the modular tile cover 621 shown in FIG. 3. FIG. 7 is a side view of the cover shown in FIG. 6. Cover 621 is generally rectangular, has four corners 622, 624, 626 and 628, and comprises a top surface 623 and a bottom surface 625. As shown in FIGS. 6 and 7, the cover 621 bottom surface 625 is preferably planed or machined at the corners 622, 624, 626 and 628. Preferably, the bottom surface corners are planed or machined into a rounded or a convex shape. With this preferred embodiment, covers of adjacent connected modular tiles form a common point wherein cabling and other electrical devices are installed. Installation of cabling between adjacent connected modular tiles at this common point is shown in FIG. 3. Covers 621 of adjacent modular tiles 93 and 95 and modular tile connect 99 define a chamber 81 wherein cabling 83 is installed. This construction also provides additional support to the modular tiles. For example, cover 621 of tiles 93 and 95 is supported not only by upper column members 645, 647, 649 and 651, but also by a modular tile connect 99.

Returning to FIGS. 4 and 6, cover 621 comprises an array of apertures or holes 675. The apertures 675 are adapted to receive a protruding portion of an indexing element associated with a work environment element. Where modular tiles 95 are connected to form a platform, cover apertures 675 provide an array of equally spaced columns and rows of apertures. The cover 621 and more preferably the modular tile 95 is rigid and stable enough to support the indexed work environment elements. Preferably, each cover 621 comprises nine apertures arranged in three rows and three columns. In the preferred embodiment of the modular tile 95, cover apertures 675 cooperate with both the horizontal portion member apertures and the corner member apertures to enable a protruding portion to be indexed.

Lower surface 625 of cover 621 comprises four downwardly facing holes or connecting points 692, 693, 694 and 695 located at the corners 682, 683, 684, and 685 of cover 621, respectively. Preferably, downwardly facing holes 692, 693, 694 and 695 cooperate with a tile connect to connect adjacent modular tiles.

As shown in FIG. 4, a floor covering 601 is disposed on the top surface 623 of cover 621. Floor covering 601 is any type of floor covering generally known in the art including but not limited to carpeting, tile or other floor covering material. Floor covering 601 is glued, stapled or otherwise affixed to cover top surface 623 in any of the standard methods known to one of ordinary skill in the art. Alternatively, floor covering 601 is releasably affixed to cover top surface 623 to allow for replacement of soiled or worn coverings.

Floor covering 601 is affixed to the cover 621 such that its edges are flush against the edges of cover 621. Alternatively, floor covering 601 is affixed to cover 621 such that it has a small nap extending beyond the edge surfaces of cover 621. In this preferred embodiment, the spacing between two connected modular tiles will be hidden since the nap fills in what otherwise would be a noticeable space between the connected tiles.

Floor covering 601 comprises an array of apertures 679. Apertures 679 are arranged so that, when the floor covering 601 is disposed on the top surface 623 of cover 612, the floor covering apertures 679 correspond to the cover apertures 675.

An insulation member 631 is affixed to the lower surface 625 of cover 621. Insulation member 631 comprises an array of apertures 679 arranged so that, once the insulation member 631 is affixed to the cover 621, the insulation member apertures 679 correspond to the cover apertures 675 and the floor covering apertures 679. In the preferred embodiment, a generally horizontal conductor 708 is disposed between the cover 621 and the insulation member 631.

The modular tile 95 shown in FIGS. 1–4 can be connected to other modular tiles using various types of modular tile connects. As previously mentioned, the modular tile connects cooperate with the connecting points 845, 847, 849 and 851 of base structure 641 and corner members 800. FIG. 4 shows three preferred embodiments of modular tile connects: a four-way connect 301, a three-way connect 401, and a two-way connect 501. FIGS. 8 through 13 show these preferred embodiments of modular tile connects in greater detail.

Figure 8:
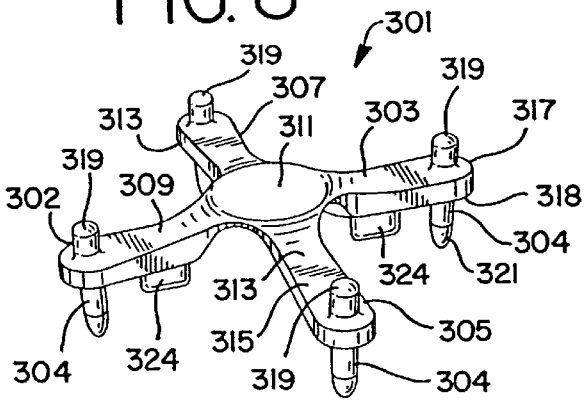
FIG. 8 is a perspective view of a four-way tile connect used to connect four of the modular tiles shown in FIG. 2.
Figure 9:
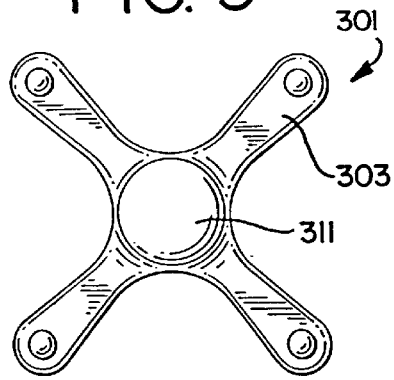
FIG. 9 is a top view of the four-way tile connect shown in FIG. 8.

FIG. 8 is a perspective view of the modular tile four-way connect 301 shown in FIG. 4. Preferably, the four-way connect 301 has four connecting members 303, 305, 307 and 309 which extend from a central member 311. Preferably, as shown in FIG. 3, central member 311 has a convex shape which further defines the convex channel 83 formed by the adjacent covers of adjacent modular tiles 91 and 93.

Connecting members 303, 305, 307 and 309 of the four-way connect 301 each have a first portion 313 and a second portion 315. First portion 313 is in communication with central member 311 and second portion 315 extends outwardly from central member 311. Each connecting member 303, 305, 307 and 309 has a top surface which together define a common upper surface 317. Each connecting member 303, 305, 307 and 309 also has a bottom surface which together define a common bottom surface 318. A spacing member 324 is provided on the bottom surface of each connecting member. Spacing member 324 cooperates with the bottom portion of a connected modular tile such that a connecting member is positioned a predetermined distance above a modular tile horizontal portion. For example, as shown in FIG. 3, the spacing element 925 of modular tile connect 99 positions the modular tile connect a predetermined distance above the connected base portions 585 of modular tiles 93, 95.

A downwardly directed pin 321 is disposed on common bottom surface 318 at second portion 315 of each connecting member 303, 305, 307 and 309. Preferably, downwardly directed pin 321 is adapted to releasably connect to points 845, 847, 849 and 851 of modular tile base structure 641 through a corner upper support member 800. Alternatively, the downwardly directed pin 321 engages a conductor disposed on a horizontal portion of the modular tile.

An upwardly directed pin 319 is disposed on top surface 317 at the second portion 315 of connecting members 303, 305, 307 and 309. Upwardly directed pins 319 releasably connect downwardly facing holes 692, 693, 694 and 695 disposed on the lower surface 625 of cover 621 through insulation member 631. Preferably, upwardly directed pins 319 engage the conductor 708 disposed between the cover 621 and insulation member 631.

In the preferred embodiment, a first cylindrical conductor 302 is disposed on upwardly directed pin 319 and a second cylindrical conductor 304 is disposed on downwardly directed pin 321. As will be discussed with reference to FIG. 19, the first and second conductor 302, 304 electrically connect to a horizontal conductor when the pins 319, 321 mate with a modular tile connecting point.

Figure 10:
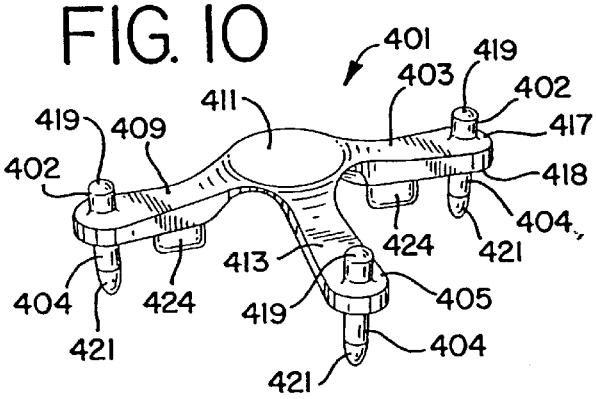
FIG. 10 is a perspective view of a three-way tile connect used to connect three of the modular tiles shown in FIG. 2.
Figure 11:
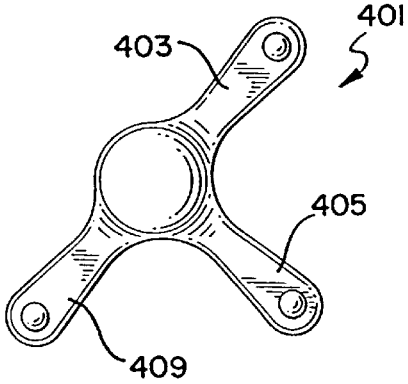
FIG. 11 is a top view of the three-way tile connect shown in FIG. 10.
Figure 12:
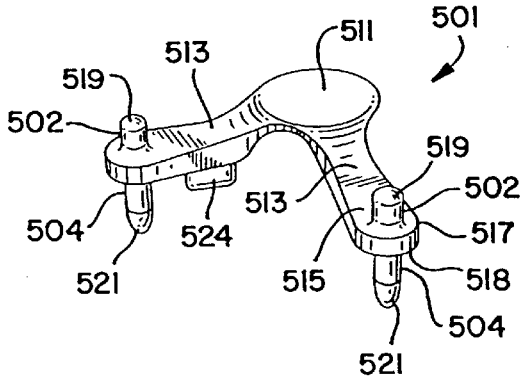
FIG. 12 is a perspective view of a two-way tile connect used to connect two of the modular tiles shown in FIG. 2.
Figure 13:
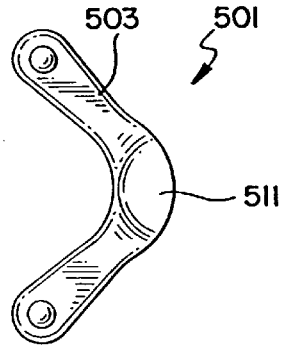
FIG. 13 is a top view of the two-way tile connect shown in FIG. 12.

Preferably, four-way connect 301 is an integral device. More preferably, tile connect 301 is made from the same material as base structure 641.

Where four modular tiles reside adjacent one another, the four connecting members 303, 305, 307 and 309 of four-way connect 301 releasably connects four modular tiles. Depending on the modular tile platform configuration and the number of modular tiles to be connected, tile connects having less that four connecting members may be required. For example, where only two corners of two adjacent modular tiles are to be connected, a two-way connect 501 is required. FIG. 12 shows a perspective view of a two-way connect 501. FIG. 13 is a top view of two-way connect 501 shown in FIG. 12. Where three modular tiles are configured so that one corner of only three tiles meet at a common point, a three-way connect is required. FIG. 10 shows a perspective view of a three-way connect 401. FIG. 11 is a top view of three-way connect 401 shown in FIG. 10. The description and mechanical construction of the two-way and three-way connect is similar to the description and construction of the four-way connect 301 previously provided.

Figure 18:
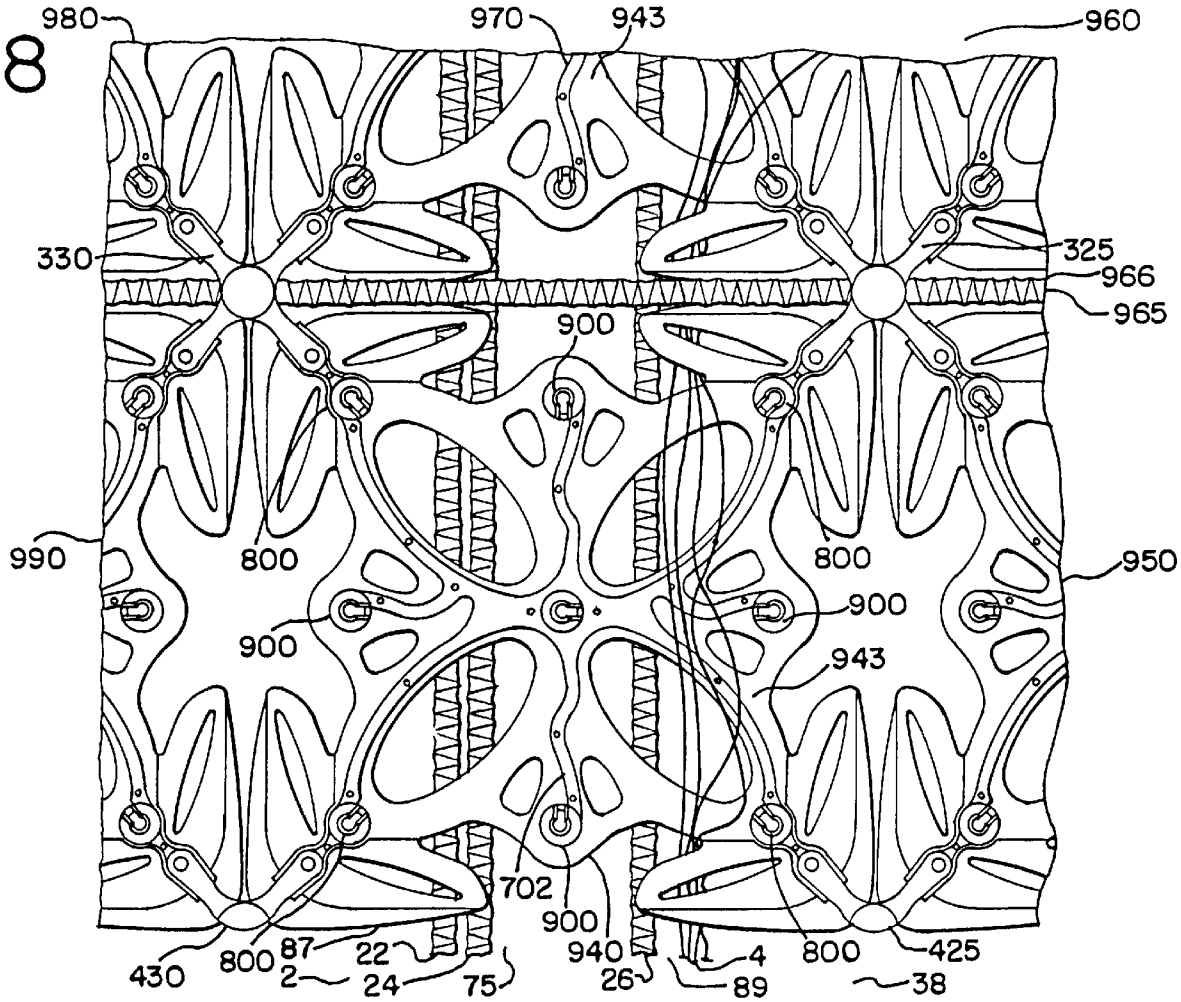
FIG. 18 is a top view of a portion of the modular tile platform shown in FIG. 2 with the top portion of the modular tiles removed.

FIG. 18 is top view of a portion of the modular tile platform 39 shown in FIG. 2 with the top portion of the modular tiles removed. FIG. 18 shows six connected base structures 940, 950, 960, 970, 980 and 990 and cabling 2, 4. Base structure 940 is connected to the five adjacent base structures 950, 960, 970, 980 and 990 on top of existing floor 38. Base structure 940 is connected to base structures 960 and 970 via four-way connect 325 and connected to base structures 970 and 980 via four-way connect 330. Base structure 940 is connected to base structures 950, 990 via two-way connects 425, 430, respectively. All six base structures have generally the same mechanical characteristics of base structure 641 previously described and shown in FIGS. 1–4.

Cabling 2 is managed beneath the horizontal portion while cabling 4 is managed on top of the horizontal portion. Preferably, power cabling 2 and communications cabling 4 is managed within the upper chamber 75 and the lower chamber 79, respectively. Power cabling 2 comprises three cables 22, 24, and 26. Cables 22 and 24 are installed in channel 87 of lower chamber 75 and cable 26 is installed in lower channel 89. Communications cabling 4 passes along the top surface of horizontal portion 943 of connected base structures 940 and 970 and is installed in channel 85 of upper chamber 75.

FIG. 18 also shows cabling 965 passing within a chamber 966 formed between adjacent base structures. For example, cable 965 passes between the chamber formed between base structures 960, 950. This type of cabling management within a chamber can be more clearly seen with respect to FIG. 3 where cabling 83 is managed in chamber 81 between modular tiles 93, 95.

Base structure 940 comprises a generally horizontal conductor 702 disposed on top of horizontal portion 943 of base structure 940. Preferably, conductor 702 is either riveted or heat staked to base structure 943. More preferably, conductor 702 is disposed between the releasably affixed five horizontal portion members 900, four corner members 800 and the base structure horizontal portion 943.

Preferably, conductor 702 is chrome plated steel having a thickness dependent upon the current carrying requirements of the conductor. Preferably, the thickness is between 0.010 and 0.050 inches. Conductor 702 has essentially the same overall length and width as base structure 940. In the preferred embodiment, a second conductor 708 having generally the same electrical and mechanical characteristics as conductor 702 is disposed underneath the modular tile cover. More preferably, if powered from a power source, conductor 702 and 708 define a circuit 709 for distributing electrical power to various electrical outlet points in the modular tile.

Figure 20:
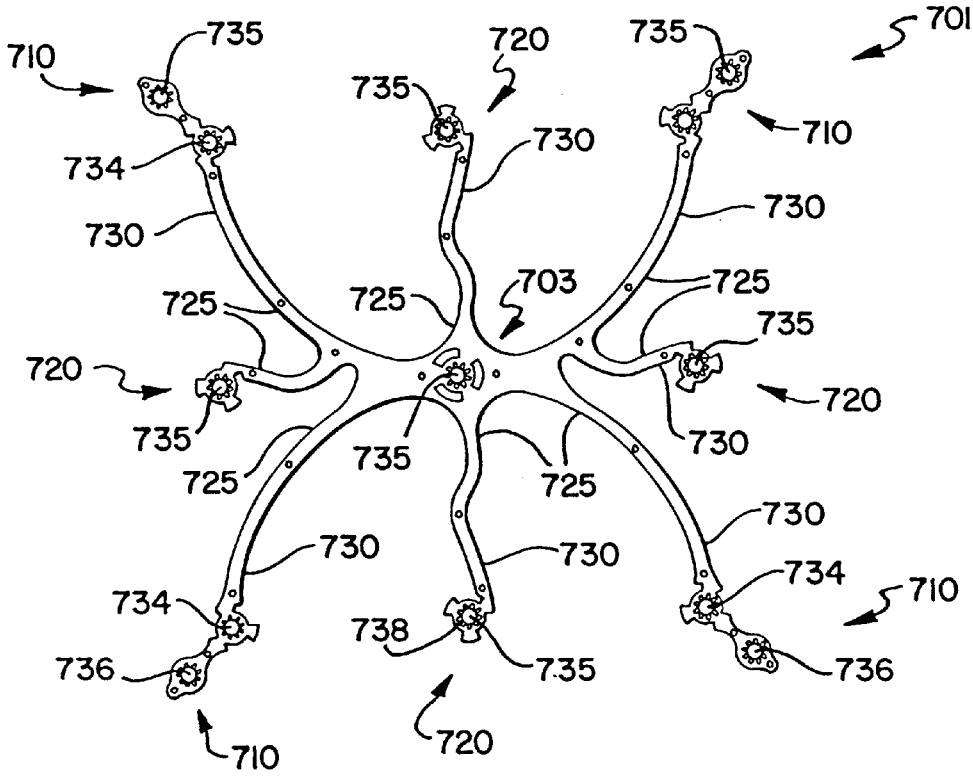
FIG. 20 is a top view of a generally horizontal conductor of the modular tiles shown in FIG. 18.

FIG. 20 is a top view of a preferred embodiment of conductors 702, 708. Conductors 702, 708 comprise a central member 703, mating holes 704 and two types of conducting members: corner conducting members 710 and mid-point conducting members 720. Conducting members 710, 720 extend from the central portion 703 and reside essentially in a horizontal plane. Conductor 702 is essentially horizontal so that it can be disposed on horizontal portion 943 of base structure 940. Preferably, conductor mating holes 704 of conductor 702 mate with molded protrusions disposed on the base structure 940 such that, when the conductor 702 is disposed on the base structure 940, the protrusions protrude through the mating holes 704. The protrusions are then either riveted or heat staked to secure the conductor 702 in place.

Conductor 708 is essentially horizontally disposed so that it can be disposed underneath cover 621. Preferably, conductors 702, 708 comprise four corner conducting members 710 and four mid-point conductor members 720.

Corner members 710 and mid-point members 720 comprise a first portion 725 cooperating with central member 703 and a second portion 730 extending outwardly from central member 703. Preferably, both corner members 710 and mid-point members 720 comprise electrical connecting points disposed on each respective second conductor portion 730.

Preferably, second portion 730 of mid-point member 720 comprises an electrical connecting point 735. Electrical connecting points 735 are adapted to receive a protruding portion of an indexing element associated with a work environment element. More preferably, electrical connecting points 735 are adopted to electrically connect to a protruding electrical conductor portion of the indexing element. Referring to FIGS. 20 and 5, when conductor 702 is disposed on an horizontal portion of a base structure, the five electrical connecting points 735 cooperate with the five base structure upper member holes 910. Referring to FIGS. 4, 5, 6 and 20, when conductor 708 is disposed on the bottom surface 625 of cover 621, the five electrical connecting points 735 cooperate with five cover apertures 625. Preferably, connecting points 735 have clamping means 738 which clamp and releasably affix an inserted protruding portion.

Figure 21:
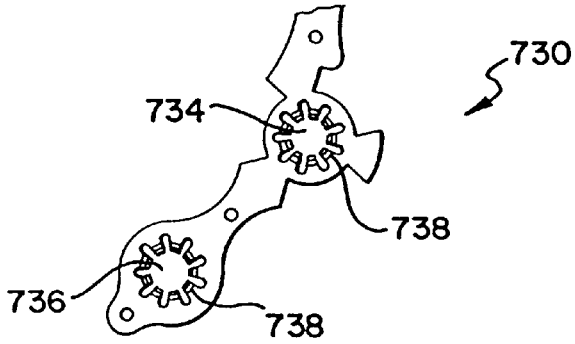
FIG. 21 is an enlarged close-up view of one of the corner electrical connecting points of the conductor shown in FIG. 20.

FIG. 21 is a close up view of second portion 730 of corner member 710. Second portion 730 comprises two connecting points: an outer electrical connecting point 736 and an inner electrical connecting point 734. Outer connecting point 736 and inner connecting point 734 have generally the same dimensions and construction as connecting points 735. Preferably, connecting points 736 and 734 have clamping means 738 which clamp and releasably affix an inserted protruding portion. Connecting point 735 is also adapted to receive a protruding portion of an indexing element.

Referring to FIGS. 21 and 5, when conductor 702 is disposed on horizontal portion 643 of base structure 641, the four inner electrical connecting points 734 cooperate with the four base structure corner member holes 860. Outer connecting points 736 are adjacent inner connecting points 734 and are adapted to receive a downwardly directed pin from a modular tile connect.

Figure 19:
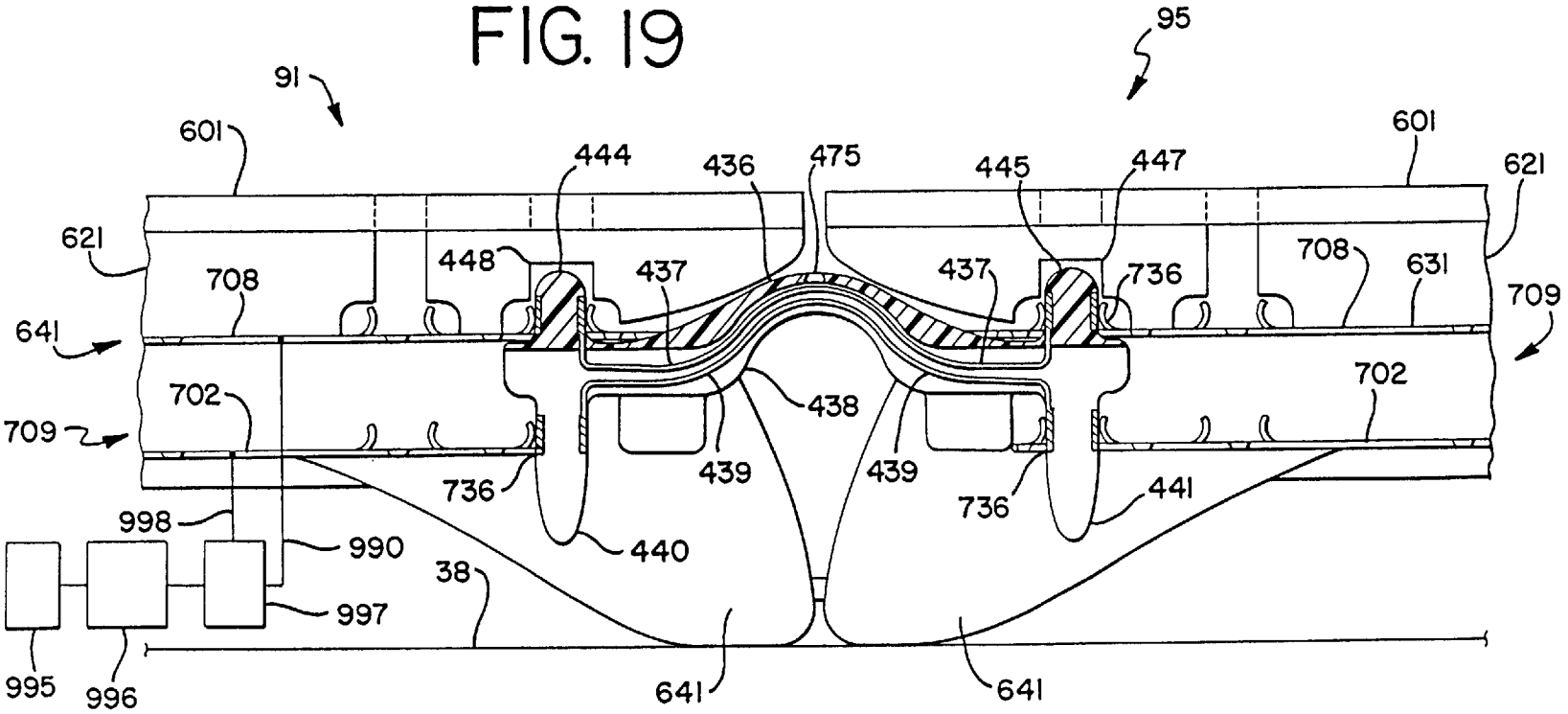
FIG. 19 is a sectional side view of two connected modular tiles taken along the line 19—19 as shown in FIG. 2.

FIG. 19 is a sectional side view of two connected modular tiles taken along the line 19—19 of FIG. 2. As shown in FIG. 19, an electrical tile connect 475 connects modular tile 91 and modular tile 95. Modular tile 95 includes a base structure 641, a first conductor 702 disposed on base structure 641, and a second conductor 708 disposed between insulation member 631 and a cover 621. First conductor 702 and a second conductor 708 together define a circuit 709. Modular tile 91 has a similar construction as modular tile 95. Tile connect 475 preferably connects a first circuit of modular tile 91 to a second circuit of modular tile 95.

The mechanical characteristics of connect 475 are similar to the previously described modular tile connects 301, 401 and 501. Tile connect 475 comprises a top surface 436, a bottom surface 438, a first and a second upwardly directed pin 444 and 445, and a first and a second downwardly directed pin 440 and 441. Connect 475 further comprises a first conductor 437 and a second conductor 439. First conductor 437 is embedded in connect top surface 436 and extends from the first upwardly directed pin 444 to the second upwardly directed pin 445. Second conductor 439 is embedded in connect bottom surface 438 and extends from the first downwardly directing pin 440 to the second downwardly directed pin 441.

To connect to circuit 709 of modular tile 95, connect 475 is placed between the cover 621 and the base structure 641. In this position, downwardly directed pin 441 releasably affixes a base structure hole such that the second conductor 439 mates with a connecting point of conductor 702 residing on base structure 641. More preferably, second conductor 439 mates with a connecting point 736 of conductor 702. This electrical connection results in second conductor 439 being at the same electrical potential as conductor 702.

When the modular tile 95 cover 621 is installed over base structure 643, upwardly directed pin 445 releasably engages a cover downwardly facing hole 447 and thereby engages second conductor 708 residing between cover 621 and insulator 631. More preferably, first conductor 437 at upwardly directed pin 445 mates with a connecting point 736 of conductor 708. This electrical connection results in first conductor 437 being at the same electrical potential as conductor 708. Connect 475 engages modular tile 91 in a similar manner. Electrical power can therefore be transmitted between modular tile 95 and modular tile 91 by way of electrical connect 475.

Preferably, modular tiles connected together in a modular tile platform configuration define a power grid. Based on the configuration of the modular tile platform, the power grid may extend throughout an entire platform or only among those connected modular tiles having a circuit comprising a first and second conductor. The preferred power grid is a low voltage D.C. power grid. This low voltage power grid supplies D.C. power to tools including notebook computers, calculators, lamps or other similar type tools requiring low voltage D.C. power.

Connect 475 of FIG. 19 represents a general side view of either the four-way connects 325, 330 or the two-way connects 425, 430 shown in FIG. 18. Alternatively, connect 475 represents a general side view of a three-way connect.

In an alternative embodiment, a modular tile without a first and a second horizontal conductor is connected to a conducting modular tile. For example, a platform such as the one shown in FIG. 2 may have both conducting and non-conducting modular tiles connected to one another. Electrical power can then be distributed according to the previously described method only to the conducting modular tiles. Electrical power can therefore be selectively distributed among modular tiles by using an electrical modular tile connect 475.

Together, the first conductor 702 and the second conductor 708 define a circuit 709. Once energized, circuit 709 distributes electrical power to the various conductor connecting points 734, 735 and 736 within a modular tile. Preferably, the circuit 709 defines a low voltage circuit (i.e., 5–50 Vdc). Conductors 702, 708 are sized appropriately to handle the required loading.

As previously discussed with reference to FIG. 19, the modular tile circuit 709 of modular tile 91 may be powered from adjacent modular tile 95. Alternatively, modular tile 91 receives power from an exterior source 995. Preferably, the external source powers a transformer 996 which in turn provides power to an electrical connector 997. Electrical connector 997 has two leads 998, 999 which are connected to the first and second conductors 702, 708, respectively. Alternatively, the transformer 996 connects directly to the conductors 702, 708. Transformer 996 either isolates or steps-down the incoming power from the exterior source 995. The transformer 996 or the electrical connector 997 are installed either on top of the modular tile 91 or within one of the modular tile chambers.

Figure 31:
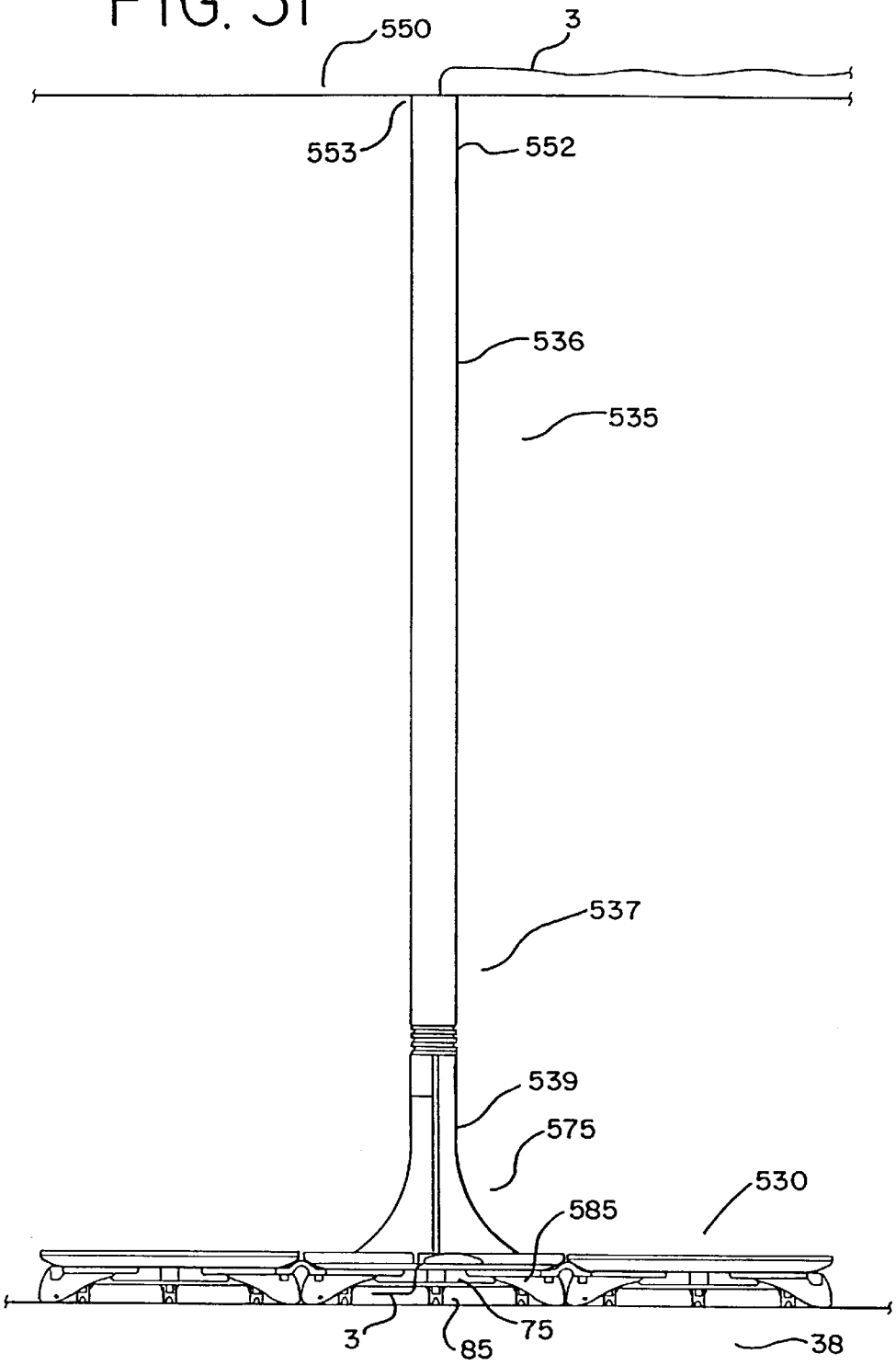
FIG. 31 is a side view of a modular tile platform work environment according to another alternative preferred embodiment of the present invention.
Figure 32:
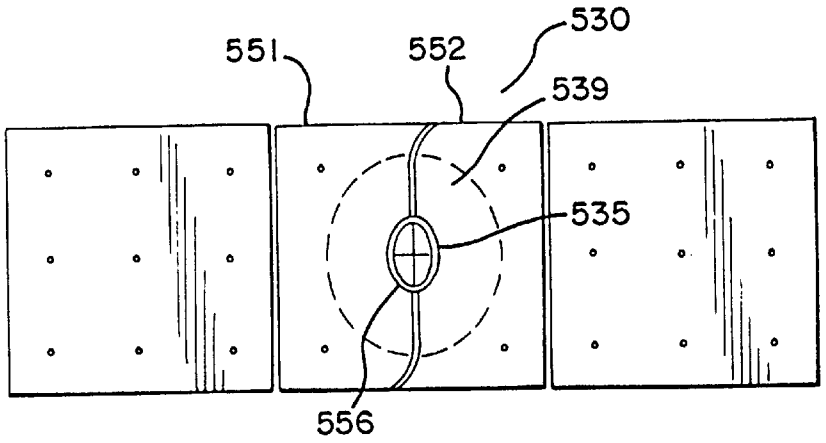
FIG. 32 is a partial sectional top view of the modular tile platform work environment shown in FIG. 31.

FIG. 31 is a side view of a modular tile platform 530 according to an alternative embodiment of the present invention. FIG. 32 is a top view of the modular tile platform 530 shown in FIG. 31.

FIG. 31 shows a ceiling 550, a cabling member 535 and a modular tile platform 530 installed over an existing floor 38. Ceiling 550 comprises cabling 3 and at least one connecting point 553. Cabling 3 provides either low voltage electrical power (i.e., 115/120 Vac), high voltage electrical power (ie., 240 Vac), or low voltage direct current power (i.e., 5–50 Vdc). Alternatively, cabling 3 transmits communications. At least one connecting point 553 for connecting to the cabling member 535 is provided in the ceiling 550.

Preferably, cabling member 535 comprises a body portion 536 and a base portion 539. Body portion 536 comprises a first portion 552 and a second portion 537 and preferably made from extruded aluminum. First portion 552 releasably engages a connecting point 553 of ceiling 550. Second portion 537 releasably engages the base portion 539. With reference to FIGS. 31–32, body portion 536 is preferably hollow having an inner dimension such that cabling 3 can be managed within the body portion 536 from the ceiling 550 to the base portion 539. More preferably, body portion 536 is elliptical.

Preferably, base portion 539 comprises a first element and a second element 551, 552. Elements 551, 552 interface with a base structure 585 of one of the modular tiles making up modular tile platform 530. In this preferred embodiment, a cover from one of the modular tiles making up the modular tile platform 530 is removed thereby exposing a modular tile base structure. The base portion 539 interfaces with the base structure which has the same general mechanical characteristics as base structure 585 of the modular tile 95 previously described in this specification. Preferably, the base portion 539 is removably secured to the base structure in a similar fashion as the cover is secured. Therefore, commonality of base structures throughout the entire modular tile platform 530 can be maintained. Moreover, installed cabling 3 can be installed and managed in the connected modular tiles directly underneath the platform.

Cabling 3 is managed within cabling member 535 and then within base portion 539 so that the installed cabling 3 is accessible underneath base structure 585. Preferably, installed cabling 3 is managed in upper chamber 75 or lower chamber 85 modular tile 585. Installed cabling 3 can therefore be managed throughout the modular tile platform 530.

Figure 24:
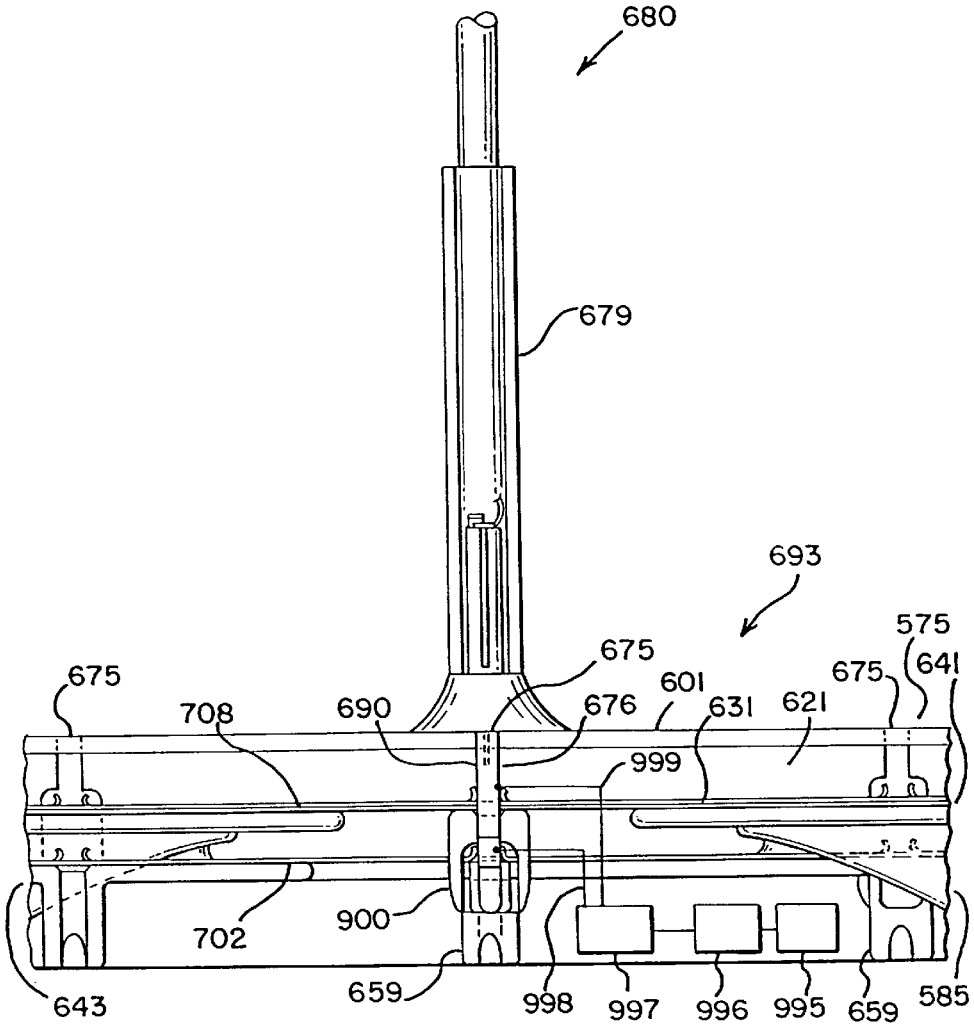
FIG. 24 is a sectional side view of a portion of the modular tile platform taken along the line 24—24 of FIG. 26 including an indexing element of a sound boom.
Figure 25A:
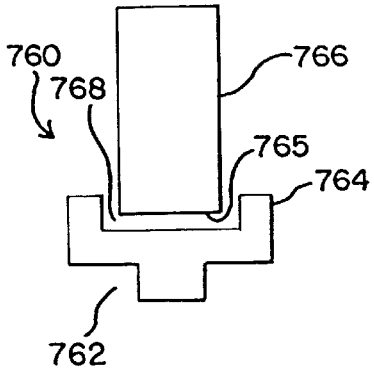
FIGS. 25(*a*–*d*) show alternative preferred embodiments of a modular tile indexing means.
Figure 25B:
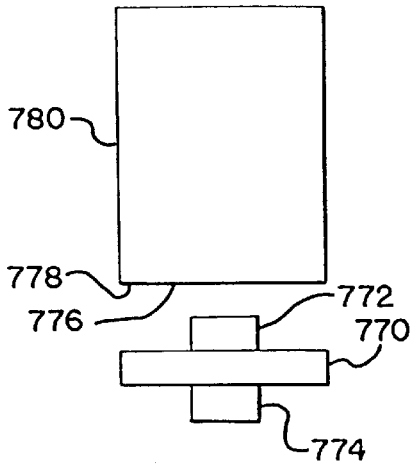
Figure 25C:
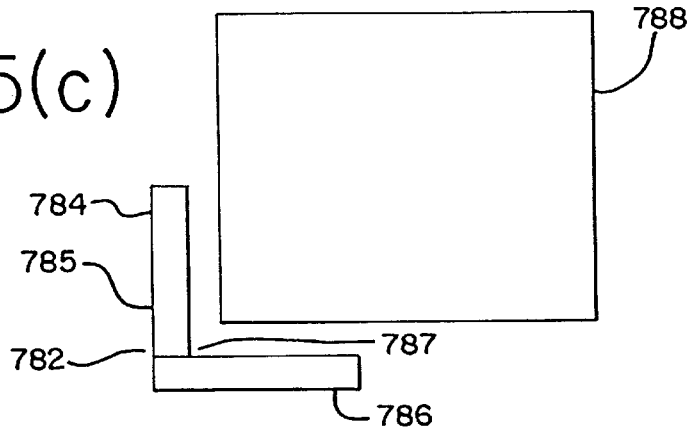
Figure 25D:
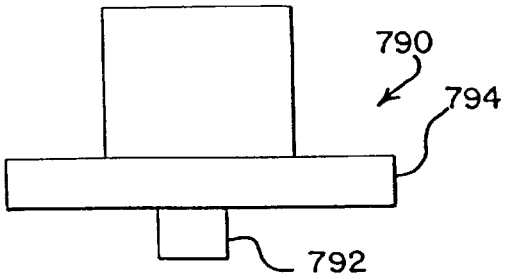
Figure 26:
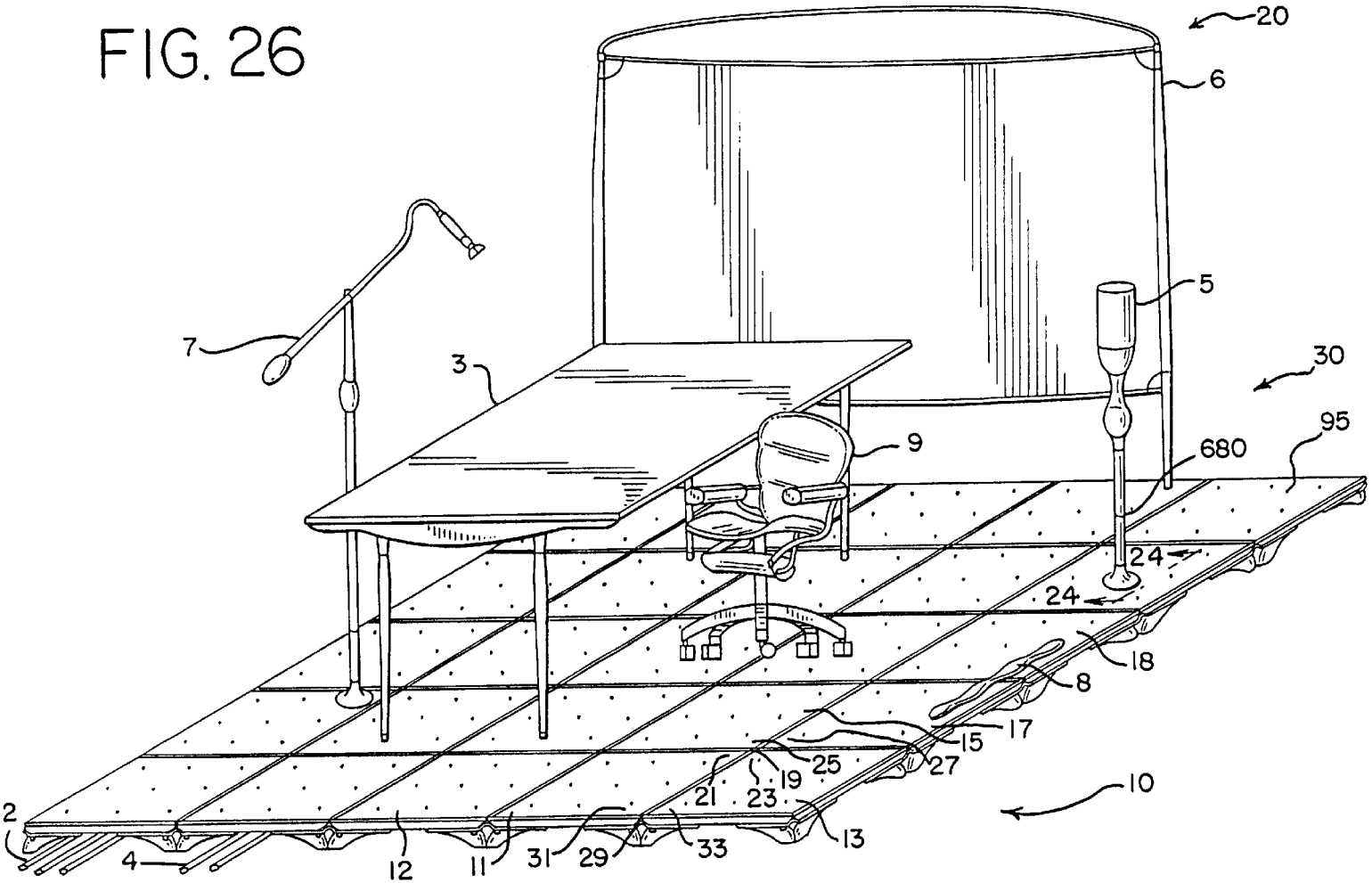
FIG. 26 is a perspective view of a platform work environment incorporating the preferred embodiment of the present invention.

FIG. 24 is a sectional side view of a portion of the modular tile platform taken along the line 24–24 of FIG. 26 showing a protruding portion of an indexing element of the sound boom 5. FIG. 24 shows modular tile 693 receiving a protruding portion 676 of an indexing element 679. Modular tile 693 comprises a top portion 575 residing on a bottom portion 585. Modular tile top portion 575 comprises a floor covering 601, cover 621, conductor 708 and insulation member 631. In this preferred embodiment, only three apertures 675 on cover 621 are shown. More preferably, nine apertures 675 are provided on cover 621.

Protruding portion 676 is releasably received into aperture 675 of cover 621. The protruding portion 675 is supported by upper portion member 900. Preferably, cover apertures 675 cooperate with horizontal portion member apertures 950 and corner column member apertures 850 such that, together, they receive and support a protruding portion of an indexing element 679 associated with work environment element 680.

The protruding element 676 has a first electrode 690 and a second electrode 692. Once inserted into an indexing aperture 675, the protruding portion 676 mates with the modular tile 95 such that first conductor 702 connects with the first indexing element electrode 692 and the second conductor 708 connects with the second indexing element electrode 690. More preferably, the indexing electrodes 690, 692 mate with the clamping means 738 of connecting points 734 or 735. Powering the circuit 709 will consequently provide power to the inserted indexing element 679.

Preferably, the indexing element 679 is part of a work environment element such as a leg of a work surface, a panel, a storage cabinet or a screen. Alternatively, the indexing element 679 is a work environment device requiring power such as a lamp, sound boom, work surface or like device. For example, indexing element 679 is part of the sound boom 5 shown in FIG. 26.

The modular tile circuit 709 of modular tile 95 shown in FIG. 24 may be powered as previously described with reference to the modular tile 91 shown in FIG. 19. For example, the circuit 709 could receive power from exterior source 995, transformer 996, or electrical connector 997. Alternatively, the electrical connector leads 998, 999 are connected directly to the first and second indexing element electrode 692, 690, respectively.

FIGS. 25(*a*)–(*d*) show alternative preferred embodiments of a modular tile indexing element. FIG. 25(*a*) shows work environment indexing element 760 for a work environment element having at least one leg 766. Preferably, indexing element 760 has a protruding portion 762. In this embodiment, the indexing element 760 includes an upper portion 764 adapted to releasably engage a bottom surface 765 of leg 766. Alternatively, the upper portion 764 includes an upwardly open cavity 768 for receiving the bottom surface 765 of a work environment leg 766.

FIG. 25(*b*) shows an alternative embodiment in which the indexing element 770 has an upper portion 772 which includes a protruding portion 774. The protruding portion 774 releasably engages an aperture 776 in the bottom surface of the leg 780.

FIG. 25(*c*) shows another alternative embodiment wherein the indexing element 782 includes an upper portion 784 with a first 785 and a second 786 upwardly extending wall. The first and second walls 785, 786 meet at a right angle 787 thereby adapted to engage a lower corner 788 of a work environment element 789.

FIG. 25(*d*) shows still another alternative embodiment wherein the indexing element 790 includes a protruding portion 792 for insertion into the cover apertures 675. The indexing element 790 includes a shoulder portion 794 for engaging the top surface of the modular tiles.

Figure 22:
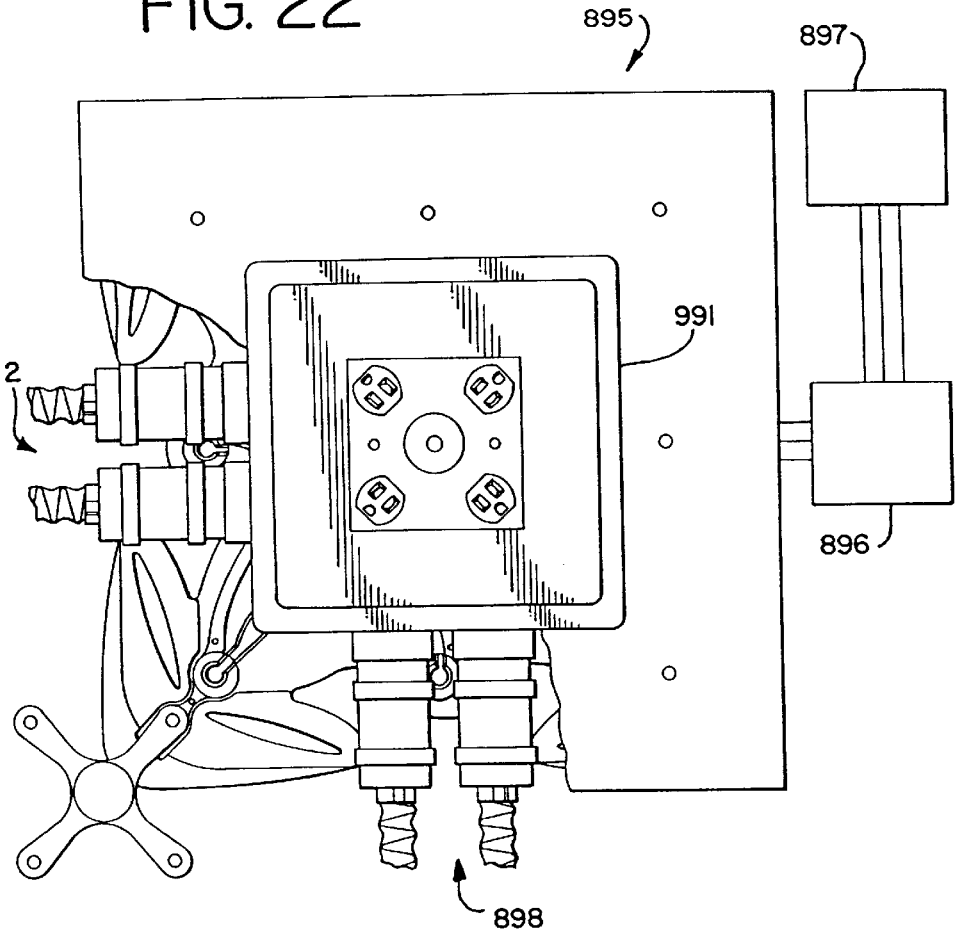
FIG. 22 is a top view of another preferred embodiment of a modular tile.
Figure 23:
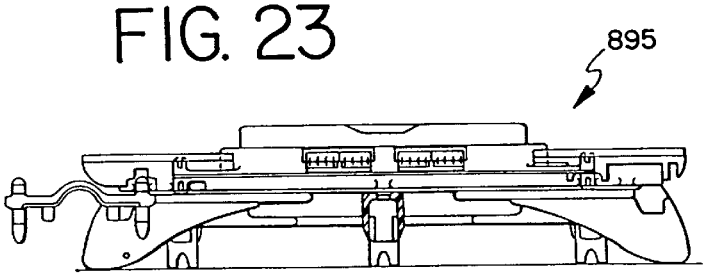
FIG. 23 is a side view of the modular tile shown in FIG. 22.

FIG. 22 shows a top view of still another preferred embodiment of the present invention. FIG. 22 shows a modular tile 895 having an outlet box 991. Power is preferably transmitted to outlet box 991 directly from cabling 2. Alternatively, power is preferably transmitted to outlet box 991 via a transformer 896. Transformer 896 is either a step down or isolation transformer receiving power from an external power source 897. Outlet box 991 is accessible from the top of the modular tile 895 and provides a convenient power connection for the occupants of the work environment. An example of a outlet box 991 that may be used in a preferred embodiment includes Model No. 55-7601 from AMP, Incorporated. FIG. 23 shows a side view of the modular tile shown in FIG. 22.

In still another alternative embodiment, a manufactured wiring system 898 provides power to the modular tile 895. In this embodiment, the wiring system 898 includes a number of outlet boxes 991 dispensed throughout a modular tile platform. An example of a wiring system that may be used in a preferred embodiment includes a Model No. 556731, 556173-1, or 556794-1 from AMP, Incorporated. The wiring system 898 is dispensed either over the existing floor or within the chambers of the modular tiles. The outlet boxes 991 can be connected to distribute power to an individual modular tile rather than an entire modular tile platform.

FIG. 26 is a perspective view of a platform work environment 20 incorporating still another preferred embodiment of the present invention. Platform environment 20 comprises a modular tile platform or island 30, various work environment components installed on modular tile platform 30, and cabling 2 and 4 servicing environment 20.

Figure 27:
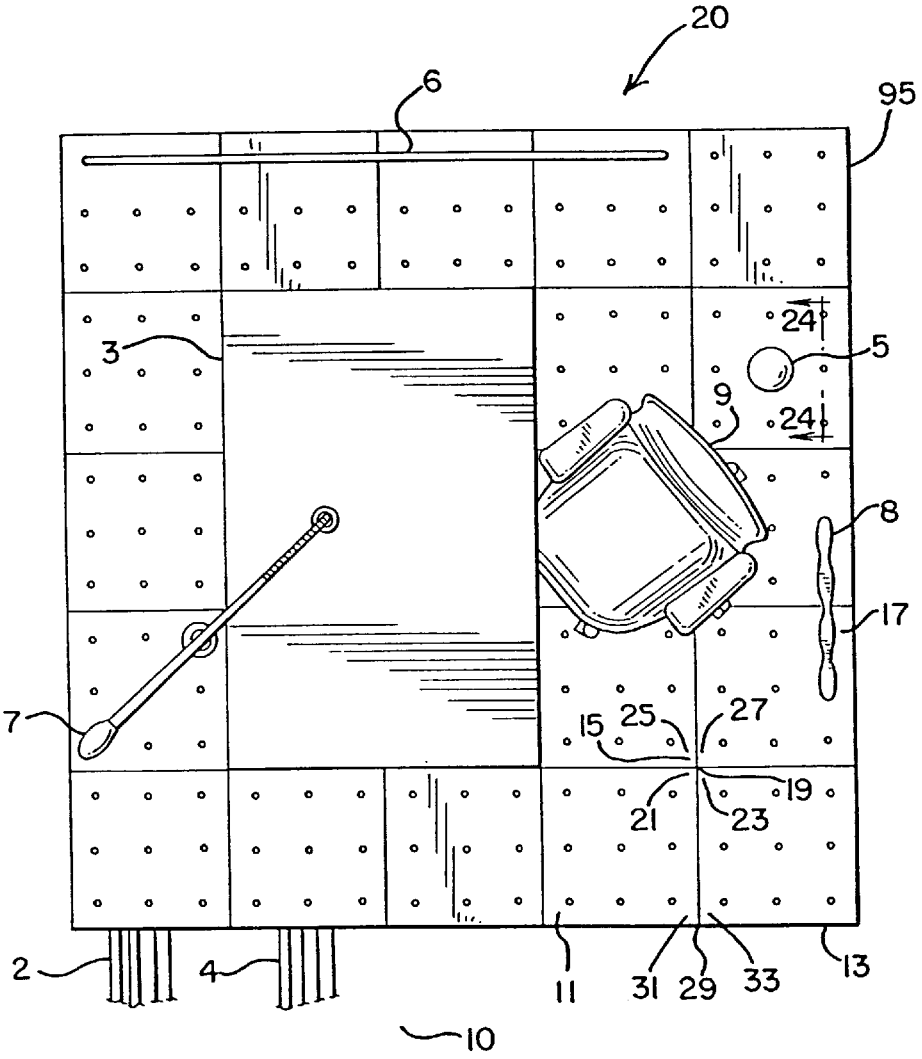
FIG. 27 is a top view of the work environment shown in FIG. 26.
Figure 28:
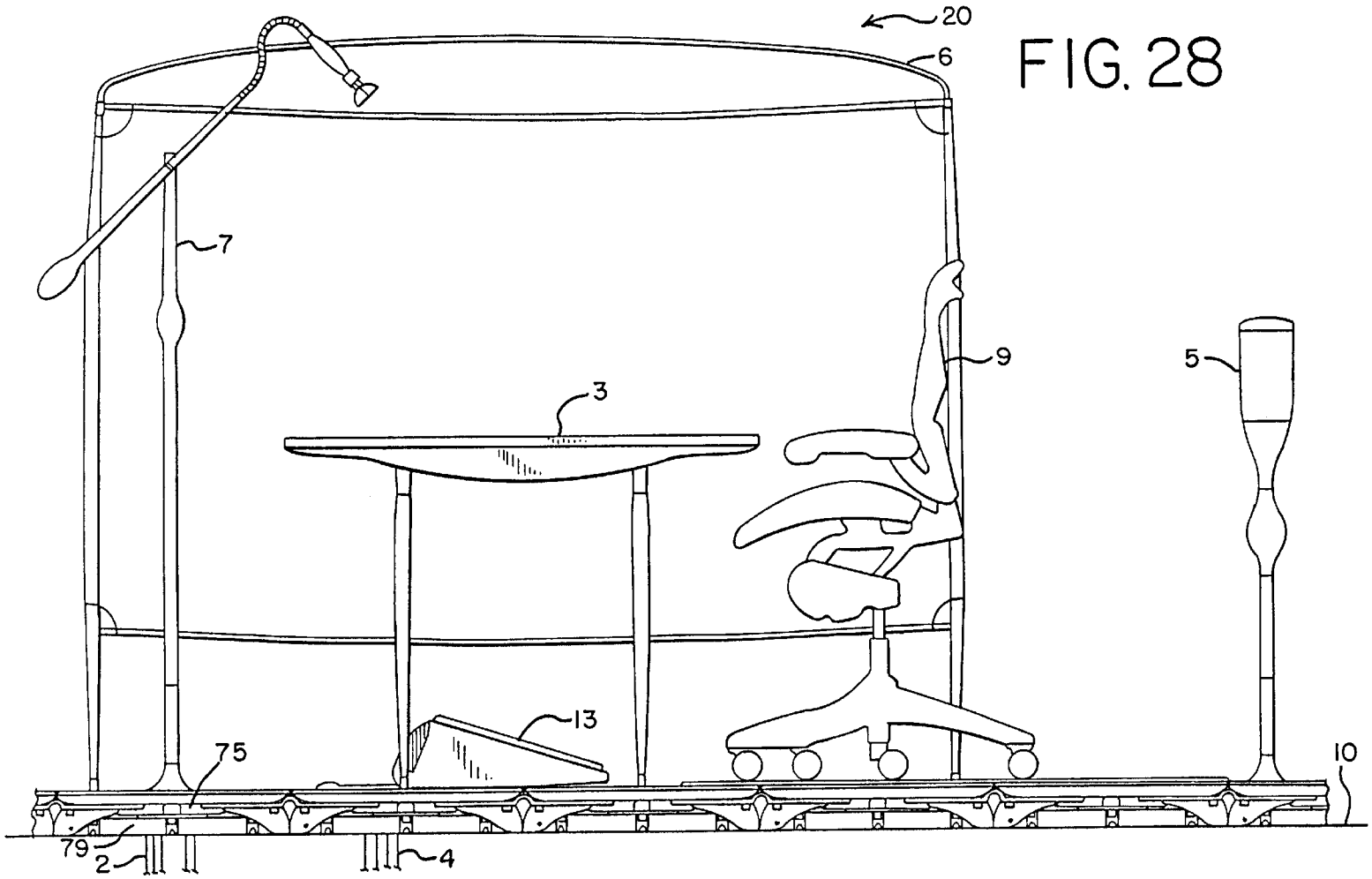
FIG. 28 is a side view of the work environment shown in FIG. 26.

Platform 30 comprises a plurality of connected modular tiles 95. As shown in FIG. 26, modular tile platform 30 comprises twenty-five (25) modular tiles 95 connected in a matrix configuration. FIG. 27 is a top view of platform work environment 20 shown in FIG. 26. FIG. 28 is a side view of platform work environment 20 shown in FIGS. 26–27.

Referring to FIGS. 26 and 27, platform 30 is installed on top of an existing floor 10 which can be a new construction foundation floor. In these types of installations, the modular tiles 95 are connected to one another to define specific zones and work areas defined by the building structure. Alternatively, platform 30 can be installed on top of an already existing raised floor panel system. In these types of retrofit applications, installation of the platform 30 is simplified since the existing floor 10 need not be disassembled or reconfigured. As shown in FIGS. 26 and 28, the modular tiles 95 are exposed along their edges. Therefore, the assembled modular tile platform 30 is preferably exposed along its edges.

The modular tiles 95 making up the platform 30 are connected in various configurations depending on the logistical and surface area requirements of the platform 30. For example, in the embodiments shown in FIGS. 26 and 27, modular tiles 11, 13, 15 and 17 are arranged adjacent one another so that a respective corner of each of the four tiles 11, 13, 15, and 17 meet at common point 19. Specifically, corner 21 of tile 11, corner 23 of tile 13, corner 25 of tile 15 and corner 27 of tile 17 meet one another at common point 19. This four tile arrangement is duplicated throughout the platform 30 until the requisite work environment surface area is configured.

Where two adjacent modular tiles 95 are arranged at the outer boundaries of the platform 30, the tiles each have a respective corner which meet at a common point. For example, outer corner 31 of modular tile 11 and outer corner 33 of modular tile 13 meet one another at common point 29. Where these two tiles meet, they are connected via a two-way connect as shown in FIGS. 12 and 13. Alternatively, modular tiles 95 are configured so that a corner of only three tiles meet at a common point and form an "L" configuration. Where these three tiles meet, they are connected via a three-way connect as shown in FIGS. 10–11. Modular platforms incorporating an L configuration are provided in the composite work environment 100 shown in FIG. 29.

Figure 29:
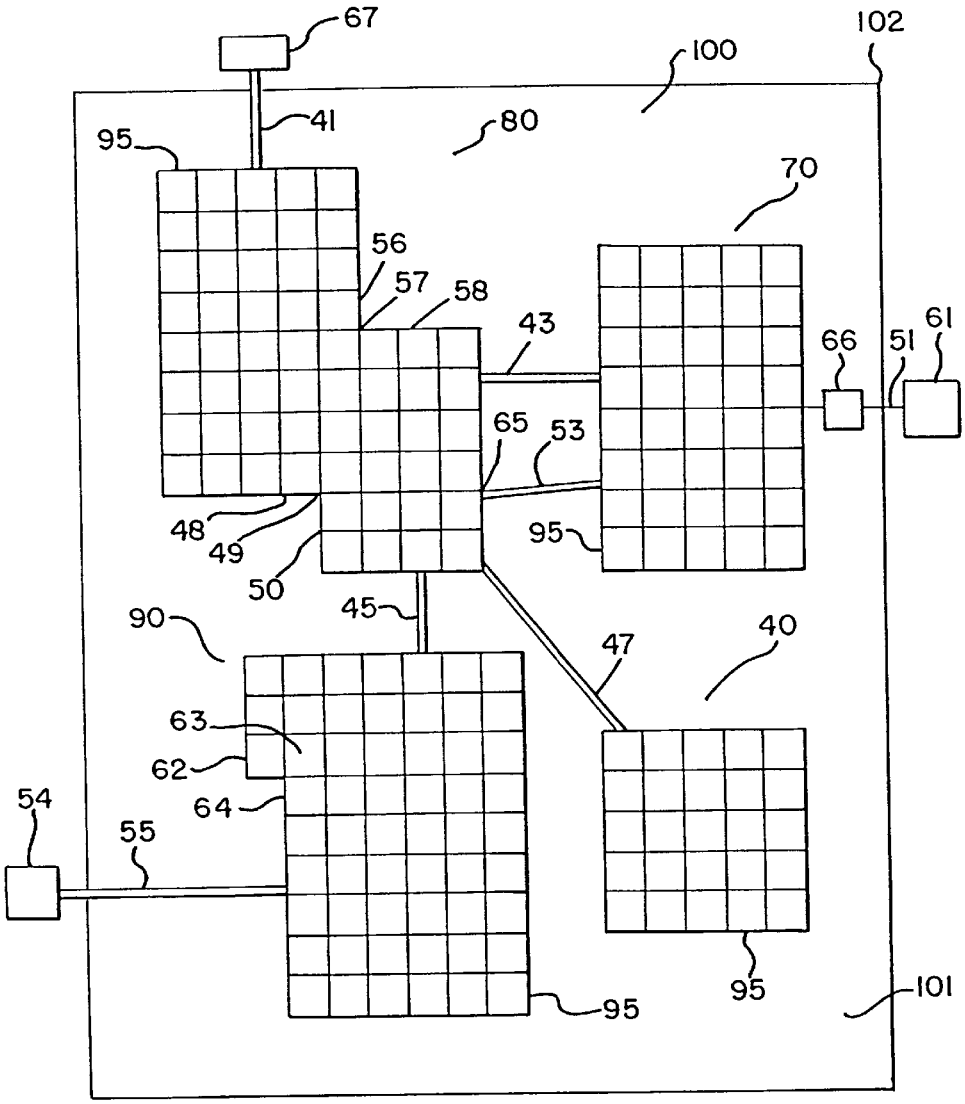
FIG. 29 is a top view of still another embodiment of the present invention.

FIG. 29 is a top view of a composite work environment 100 incorporating another preferred embodiment of the present invention. Composite work environment 100 defines an entire floor of a building 102. Alternatively, environment 100 defines only a portion of an entire floor.

As shown in the composite work environment 100 of FIG. 29, it is not required to cover the entire existing floor 101 with the modular tiles 95. Rather, a plurality of the tiles 95 are installed in a stand alone fashion to configure the modular platforms 40, 70, 80 and 90 which are suited for work environments supporting a limited number of personnel.

Composite work environment 100 comprises four isolated platform environments 40, 70, 80, and 90 all having unique configurations. Environments 40 and 70 are generally rectangular type platforms, similar to the platforms shown in FIGS. 26, 27 and 28. Platform environment 40 comprises twenty (20) modular tiles 95 configured in a five-by-four matrix. Platform environment 70 comprises forty (40) modular tiles 95 configured in a five-by-eight rectangular matrix.

Platforms 80 and 90 utilize the three tile approach in forming an L configuration. For example, in work environment 80, connected modular tiles 56, 57 and 58 and modular tiles 48, 49 and 50 form a three tile L configuration. Similarly, in work environment 90, connected modular tiles 62, 63 and 64 form an L configuration. Either of the work platforms 40, 70, 80 or 90 can be extended in width or length based on changing work environment requirements.

Alternatively, platform environments 40, 70, 80 or 90 are installed in the typical wall-to-wall configuration (not shown). In this alternative embodiment, a single platform is extended in length and width to cover an entire existing floor. Alternatively, existing modular platforms 40, 70, 80 and 90 are extended thereby tying all four modular platforms 40, 70, 80 and 90 into one work environment.

The modular tile platforms shown in FIGS. 26–29 comprise modular tiles having square covers. FIG. 36 shows an alternative embodiment of a modular tile platform wherein the modular tile covers have an hexagonal shape. FIG. 37 shows another alternative embodiment of a modular tile platform wherein the modular tile covers have a rectangular shape. In this preferred embodiment, the modular tiles are arranged adjacent one another so that a respective corner of the four tiles meet at a common point. Alternatively, as shown in FIG. 38, the modular tile covers having a rectangular shape are staggered in an off-set fashion such that only two corners of the two modular tiles meet at a common point.

Returning to FIGS. 26–28, work environment 20 comprises a number of work environment elements including a work surface 3, a sound boom 5, a light 7, a chair 9, a chair bump 8, a foot rest 13 and a movable wall 6. Other possible elements include water coolers, fans, noise cancellation devices, intelligent lap top power supplies, storage components, podiums, chairs, lighting, ambient task lighting and integrally lit free standing panels. Preferably, these elements are indexed within the modular tile platform utilizing the preferred indexing means as previously described and shown. These work elements preferably have at least one indexing element having a protruding portion (not shown in FIG. 26) which is releasably affixed to a modular tile.

To support these elements and other associated electrical devices, power, data, voice and other utilities must be brought to and distributed throughout the modular tiles and therefore the platform. Cabling 2 and 4 servicing work platform 20 are communicated to modular environment 20 in a number of different ways.

FIG. 29 shows various schemes for providing the cabling to and from the modular platforms 40, 70, 80 and 90. Cabling 2 supplies standard low voltage electrical power (i.e., 115/120 Vac). In an alternative embodiment, cabling 2 provides higher voltage electrical power (e.g., 240 Vac) and work environments 40, 70, 80, and 90 have transformer means for transforming this higher voltage. Alternatively, cabling 2 provides low voltage direct current power (i.e., 5–50 Vdc). Power and communications cabling and other electrical devices (i.e., AC/DC transformers) are installed either underneath, within or between connected modular tiles.

Work environment utilities are supplied from an existing utilities service within the work environment or from adjacent work environment zones and transmitted to the work platform in a number of different ways. In a preferred embodiment, modular platforms receive electrical power from an exterior source. For example, as shown in FIG. 29, work environment 70 receives electrical power via cabling 51 from exterior source 61. Exterior source 61 may be a load center, a control panel, or a branch circuit access point (or junction point) within the work environment building or in a remote electrical room. Preferably, the electrical power transmitted via cabling 51 is 115/120 VAC.

In an alternative embodiment, work environment 70 comprises transformer means 66 which isolates incoming electrical power supplied by exterior source 61. Alternatively, transformer means 66 steps down the incoming electrical power. Transformer means 66 is installed either underneath, on top of or within the tiles making up modular platform 70. A platform can also receive electrical power from another modular platform. For example, work environment 80 receives electrical power from work environment 70 via cabling 53.

Communication or data cabling 4 is installed in each work platform. This cabling is necessary for transmitting communications information to work platforms to service facsimile, computer networks (i.e., Internet and Intranet capabilities), phone lines and modems. Communication cabling 2 can be pulled from one work environment to another. This cabling scheme is preferred where various environments must be networked with one another (e.g., LAN, Internet, Intranets, e-mail, etc.).

In a preferred embodiment, communication or data information originates from an external source 67 and is transmitted to work platform 80 via cabling 41. From platform 80, this information is transmitted via data cabling 41 to work environment 80 and can be further re-transmitted to other work platforms. In composite environment 100, communication and data information transmitted via cabling 41 is sent to work platform 70, 90, and 40 via communication and data line cabling 43, 45, and 47, respectively. Alternatively, work platforms 40, 70, and 90 receive communication information from separate exterior communications sources.

Figure 33:
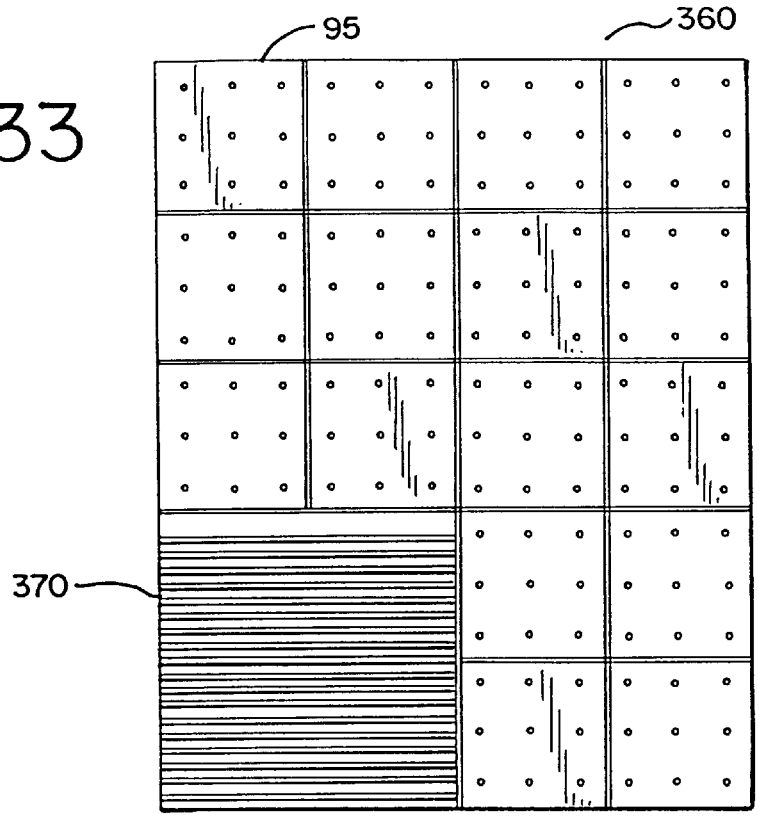
FIG. 33 is a top view of a modular tile platform incorporating another preferred embodiment of the present invention.

FIG. 33 shows still another alternative embodiment of the present invention. FIG. 33 shows a modular tile platform 360 comprising a plurality of connected modular tiles 95 and a modular tile platform ramp 370. Ramp 370 is connected to the modular tiles 95 within the modular tile platform 360 such that the resulting modular tile platform work environment 365 maintains a generally rectangular configuration. Preferably, ramp 370 has a length and a width equivalent to the length and width of four modular tiles connected in a generally rectangular platform. Therefore, as shown in FIG. 33, ramp 370 is connected to two modular tiles 95. Ramp 370 is connected to the two modular tiles via a two-way modular tile connect and a three-way modular tile connect.

Figure 34:
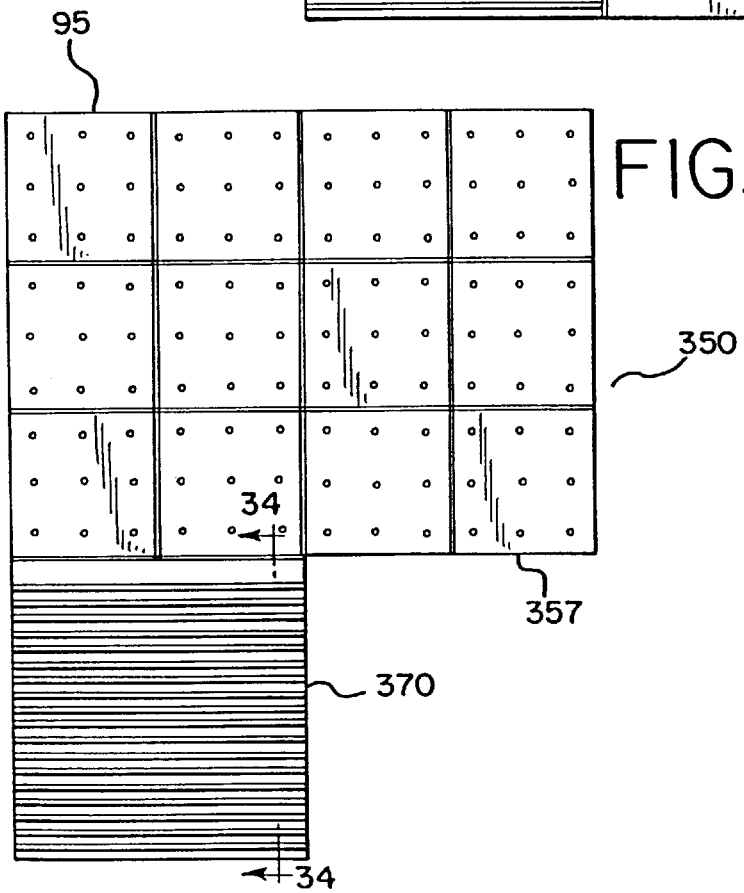
FIG. 34 is a top view of an alternative embodiment of the modular tile platform shown in FIG. 33.

FIG. 34 shows an alternative embodiment of the modular tile platform shown in FIG. 33. FIG. 34 shows a modular tile platform 350 comprising modular tiles 95 and a modular tile platform ramp 370. Ramp 370 is connected to two modular tiles 95 via a two-way modular tile connect and a three-way modular tile connect. In this alternative embodiment, ramp 370 is connected to the generally rectangular modular tile platform 350 along an exterior edge 357.

Figure 35:
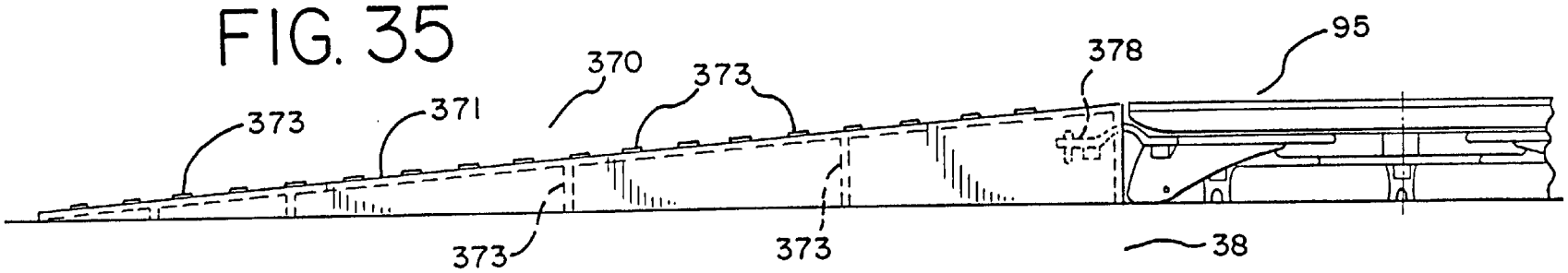
FIG. 35 is a sectional side view of the modular tile platform ramp taken along the line 34—34 as shown in FIG. 34.

FIG. 35 is a sectional side view of the connected modular tile platform ramp 370 taken along the line 34—34 as shown in FIG. 34. FIG. 35 shows the ramp 370 adjacent a modular tile 95 and installed over an exiting floor 38. Ramp 370 is connected to modular tile 95 via modular tile connect 378. Preferably, the ramp 370 has the same height as the tile 95. The ramp 370 comprises an incline 371 and is supported by a plurality of ribs 373. The ramp incline 371 is preferably covered with a floor covering 372. The floor covering 372 has ridges 373 which prevents slipping along the incline. The ramp 370 is preferably made from extruded aluminum. Alternately, the ramp 370 is a die cast of aluminum alloys. The ramp 370 facilitates accessing a modular tile platform for wheeled carts, wheelchairs and chairs.

Figure 39:
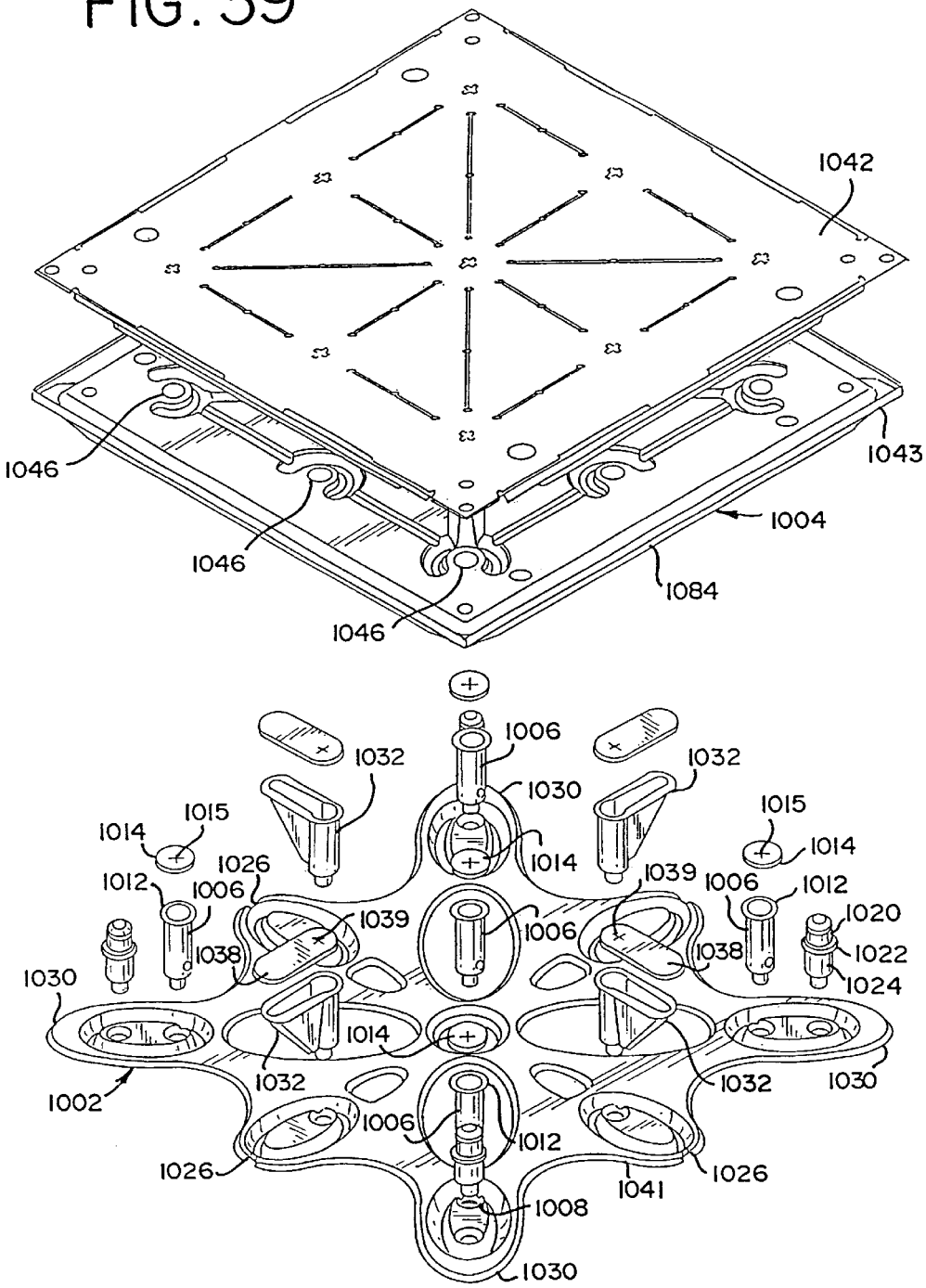
FIG. 39 is an exploded view of another preferred embodiment of a modular tile according to the present invention.

Referring to FIGS. 39 through 47, a modular tile 1000 illustrating an alternate preferred embodiment is shown. FIG. 39 illustrates an exploded view of the modular tile 1000 including a base member 1002 and a cover 1004. The base member 1002 includes a plurality of standoff members 1006 located on opposing corners of the base member 1002. The standoff members 1006, are press fit into apertures 1008 in the base member 1002. The standoff members 1006 function to support the cover 1004. In addition, the standoffs 1006 include a cavity 1012 that is covered by a seal 1014. The seal 1014 includes a cross-shaped cut 1015. Connection members 1020 are also press fit into the corners of the base member 1002. An o-ring 1022 is secured on an upper portion 1024 of the connection member 1020. The base member 1002 includes side portions 1026 intermediate between adjacent corners 1030 and a bottom surface 1031. The side portions 1026 are also useful for alignment of the floor tiles 1000 during installation. A standoff members 1032 are press fit into an aperture adjacent to the side portions 1036. The standoff members 1032 have an extended or elongated top surface 1036 that is covered by a seal 1038. The seal 1038 includes a cross-shaped cut 1039. The top surface 1036 provides additional support for the sides of the cover 1004. The seals 1038 and 1014 are preferably formed from a plastic material such as TPE and provide a non-metallic surface between the base member 1002 and the cover 1004. In this manner, any sound that could result from any movement between the these elements is lessened.

Figure 44:
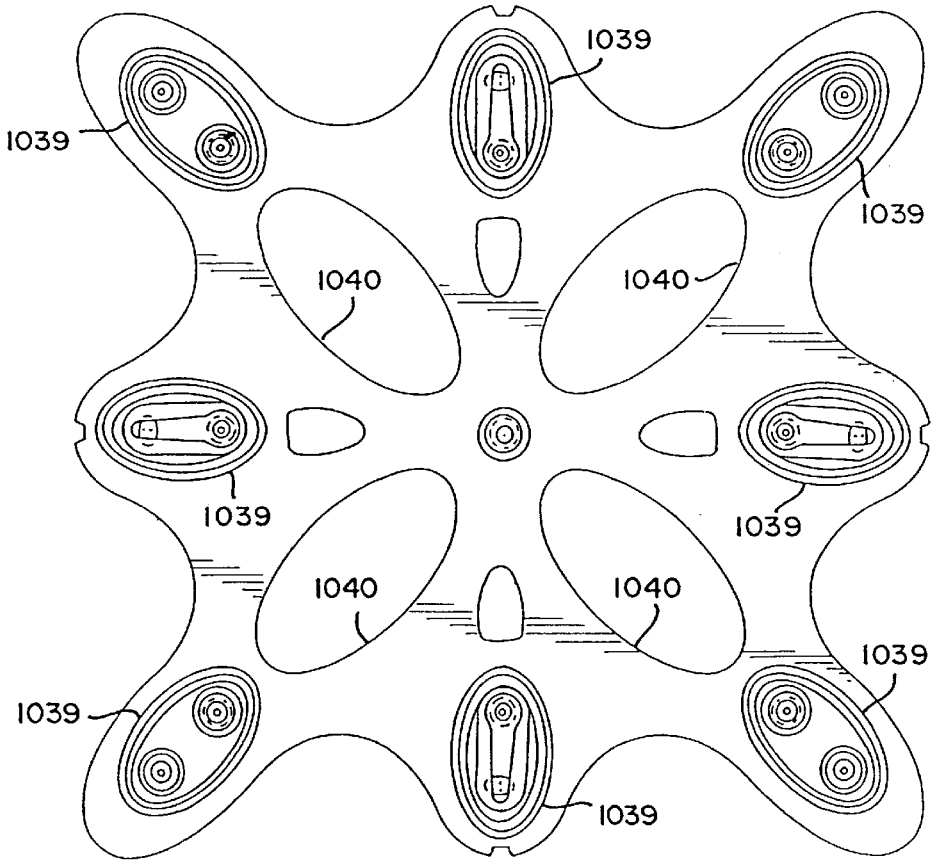
FIG. 44 is a bottom view of the base structure.

FIG. 44 illustrates the bottom surface of the base member 1002. A plurality of oval shaped tracks 1039 extend along the outer corners and intermediate side portions of the bottom surface 1031 of the base member 1002. The oval shaped tracks 1039 function to spread out any load that is being supported by the base member 1002. In this manner, it is intended that the floor surface will not become deformed through the use of the modular tile 1000. As also seen in this Figure, a plurality of material saving apertures 1040 are located in the base member 1002. The apertures 1040 also allow cabling to pass from beneath to above the horizontal portion 1041. The apertures 1040 are also useful as an opening for a hand grip during installation. Power and data cabling can be fed through a system of floor tiles and rest on the horizontal portion 1041.

Figure 45:
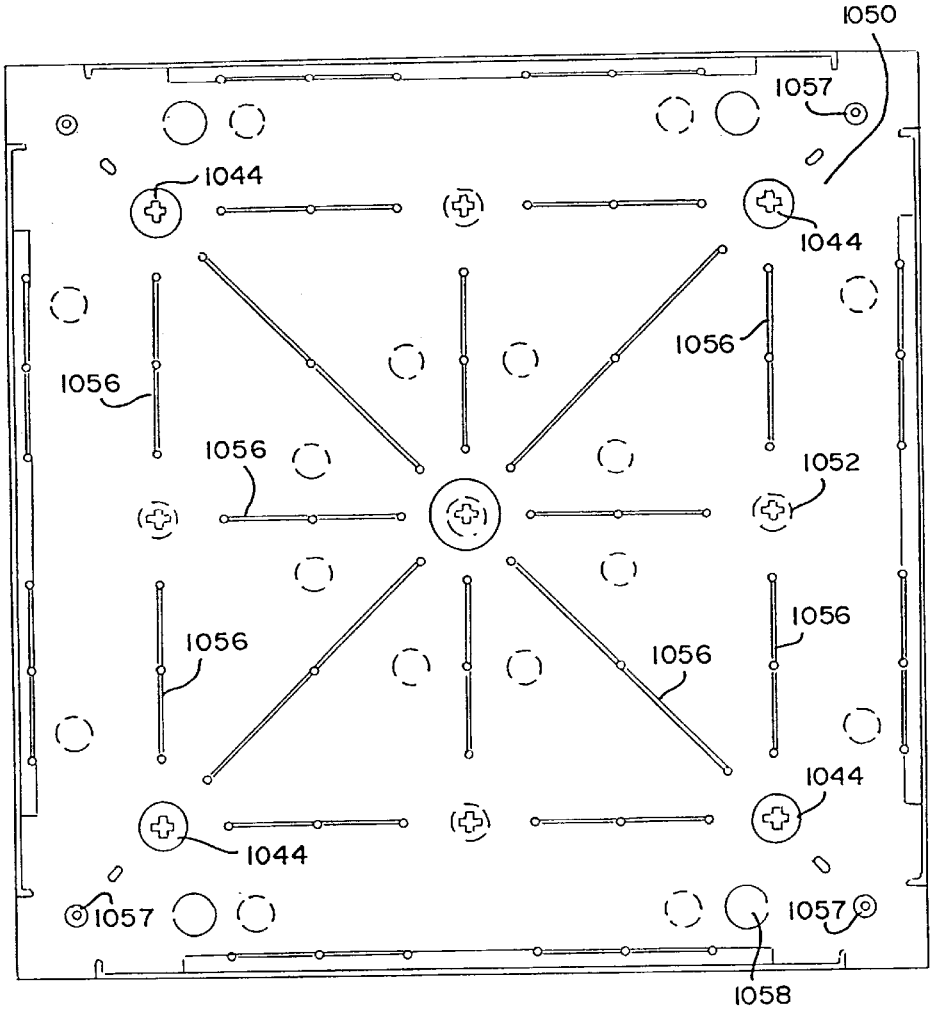
FIG. 45 is top view of the cover.

The cover 1004 is preferably made from a top portion 1042 and bottom portion 1043. The top portion 1042, as best seen in FIG. 45, includes nine cross-shaped apertures 1044. The cross-shaped apertures 1044 are adapted to receive an indexing element from a panel, screen or other work environment element. A plurality of corresponding openings 1046 extend coaxially within the bottom portion 1042 of the cover 1004. The apertures 1044 are arranged in three spaced-apart and parallel rows 1050, 1052, 1054. However, other configurations may be implemented as those of ordinary skill in the art will recognize. A plurality of drainage holes 1056 extend between each of the apertures 1044. Holes 1057 are located adjacent corners of the cover 1004. Punch-outs 1058 are located at various positions along the edges and around the center of the cover 1004. Corresponding drainage holes 1056 and punchouts 1058 are located within the bottom portion 1042.

Figure 40:
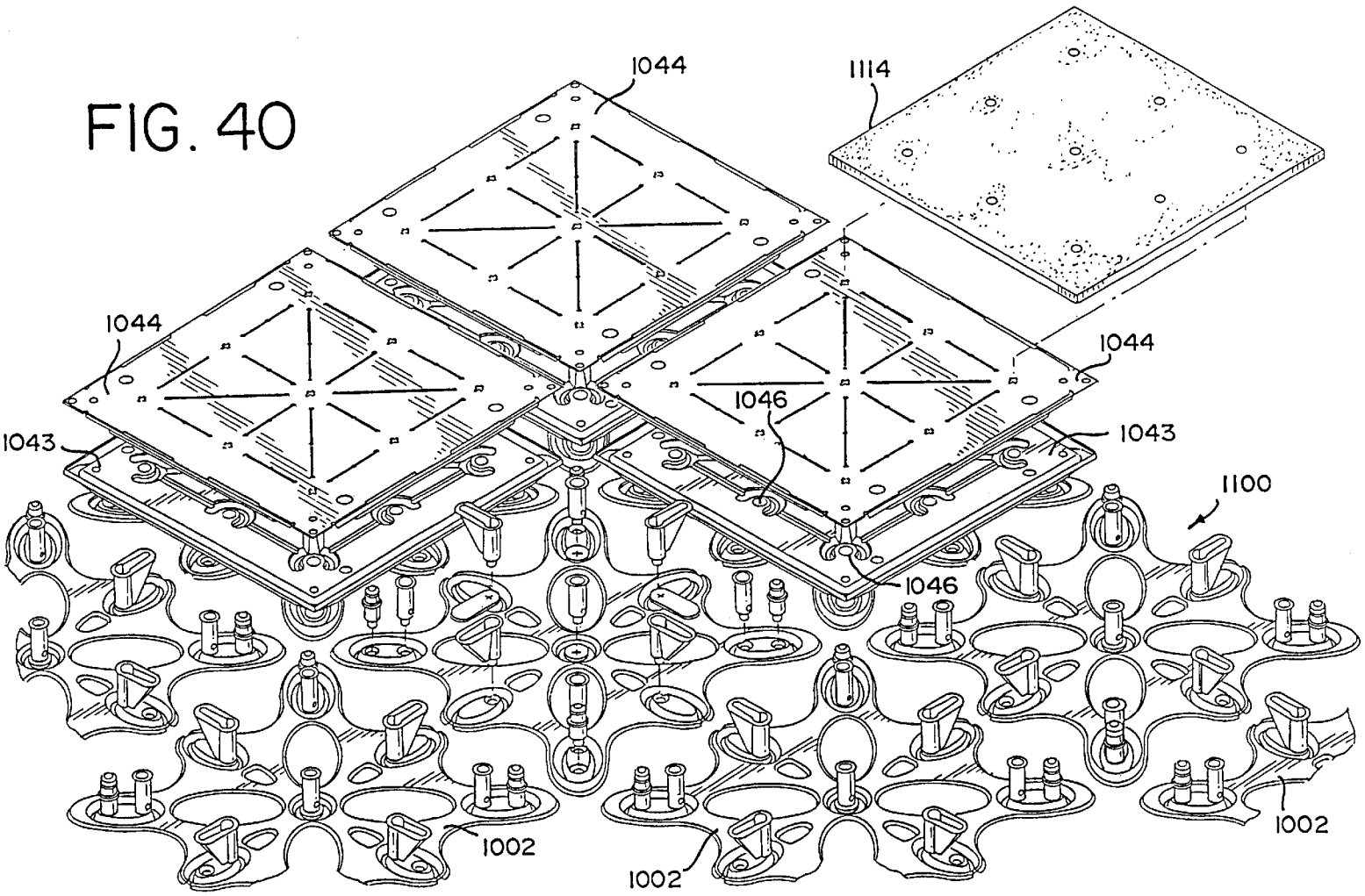
FIG. 40 is a top view of a modular platform showing the modular tile illustrated in FIG. 39.
Figure 41:
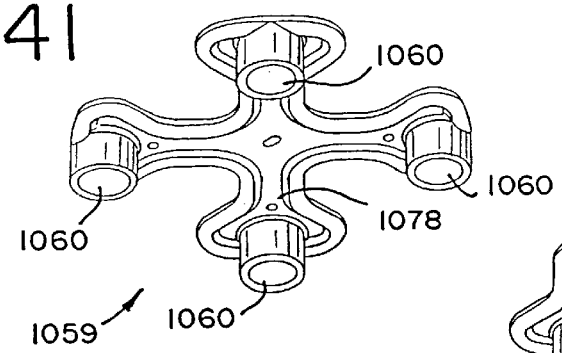
FIG. 41 is bottom view of four-way tile connect of another preferred embodiment.
Figure 43:
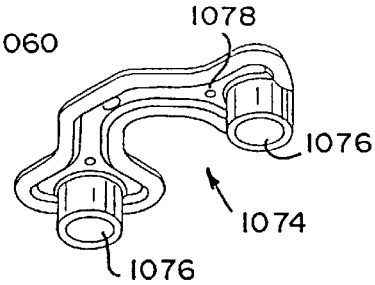
FIG. 43 is bottom view of a two-way tile connect of another preferred embodiment.
Figure 42:
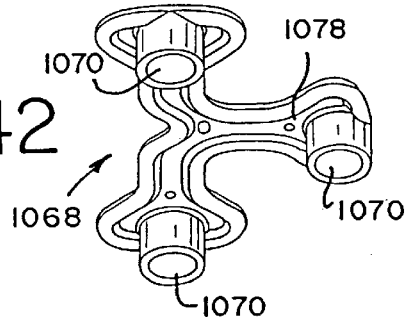
FIG. 42 is bottom view of three-way tile connect of another preferred embodiment.

As shown in FIG. 40, a plurality of modular tiles 1000 may be arranged to cover a floor 1100. The modular tiles 1000 may be interconnected using connection elements as seen in FIGS. 41 through 43. FIG. 41 illustrates a four-way connector 1059 that includes four apertures 1060 extending perpendicular to one another and adapted to be attached to the connection members 1020. The o-ring 1022 functions to provide a connection that will not produce much noise as users walk across the modular tiles 1000. FIG. 42 illustrates a three-way connection member 1068 having three apertures 1070. Each aperture is adapted to fit on top of a connection member 1020. Similarly, FIG. 43 illustrates a two-way connection member 1074 having two apertures 1076. Threaded holes 1078 may be secured to a cover 1004 threw a fastening mechanism such as screw that passed through the holes 1057. In this manner, the cover 1004 may be locked into engagement with the connections members 1059, 1068, 1074 in order to provide a more secure assembly that may be useful in areas prone to earthquakes.

The top portion 1042 and the bottom portion 1043 are connected to one another such that a bent edge 1080 extends downward along the periphery of the top portion 1042 and into a curved opening 1082 that extends along the periphery 1084 of the bottom portion 1043. An adhesive, such as two-part urethane is used to secure the top portion 1042 to the bottom portion 1043. Once bonded together, the two-part cover 1004 construction provides additional strength that prevents bending.

Figure 46:
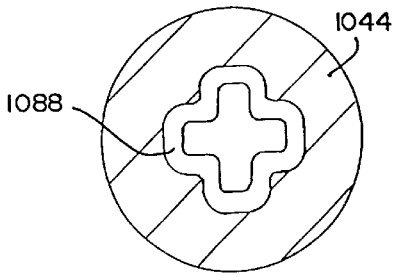
FIG. 46 is an enlarged view of one of the apertures in the cover.

FIG. 46 illustrates an enlarged view of the aperture 1044 that is shown in the top view of the cover 1004. The aperture 1044, in this preferred embodiment, has a cross-shape configuration 1088. However, other configurations could be implemented with the present invention.

Figure 47:
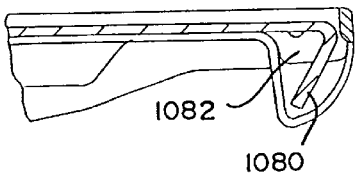
FIG. 47 is a cross-section taken along the lines 47—47 of FIG. 46.
Figure 48:
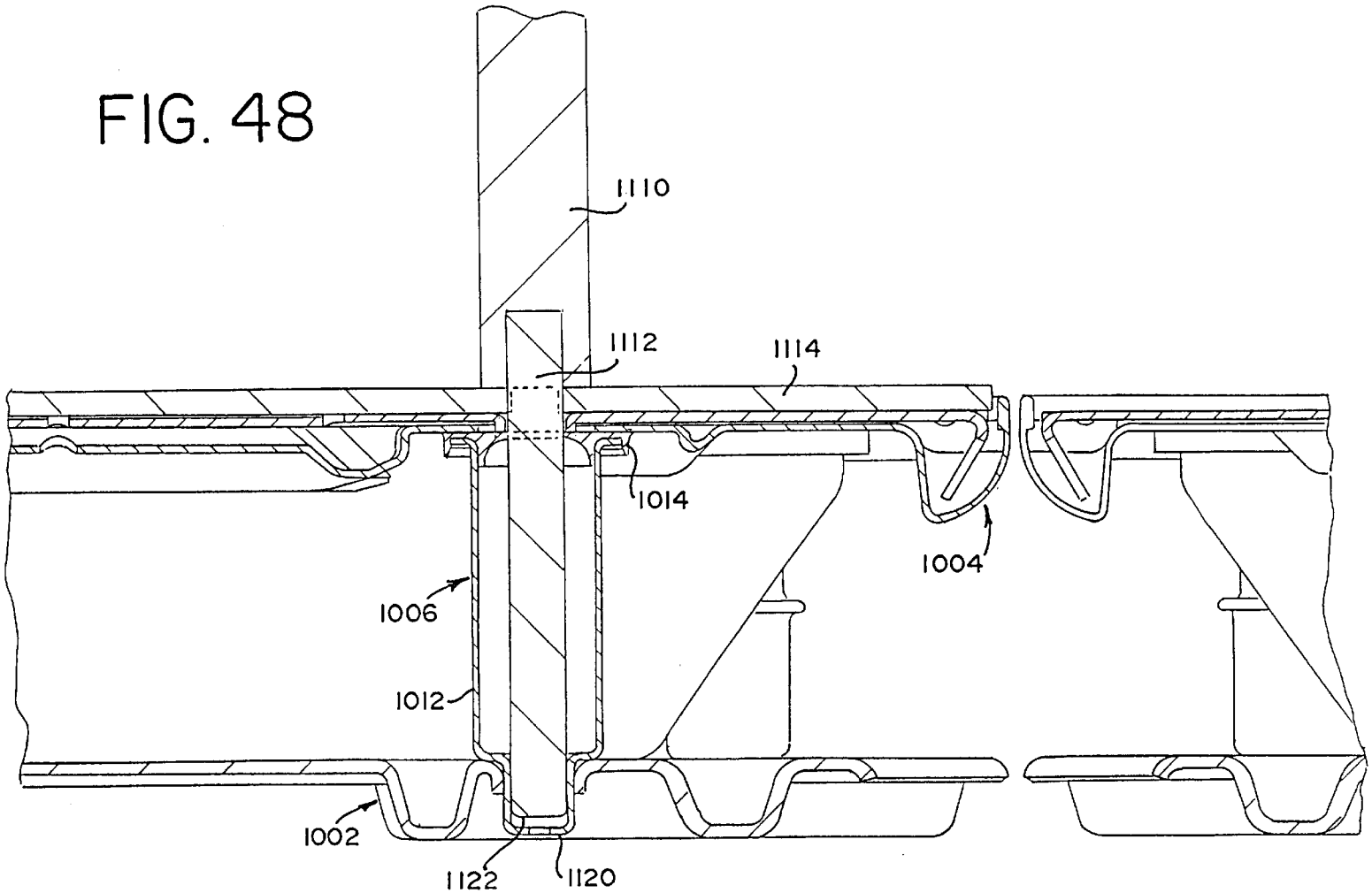
FIG. 48 is a cross-section illustrating the insertion of an index element into the modular tile as shown in FIG. 39.

FIG. 47 illustrates the connection of work element such as work surface or screen to a modular tile 1000. The leg 1110 of the work element includes an indexing member 1112. The indexing member 1112 passes through an opening in a carpet tile 1114, through the aperture 1044 in the cover 1004 and through the seal 1914 into a standoff 1006. As shown in this Figure, the standoff 1006 includes a bottom portion 1120 adapted to receive the lower portion 1122 of the indexing element 1112. In this manner, the work element is secured to the modular tile 1000.

Figure 49:
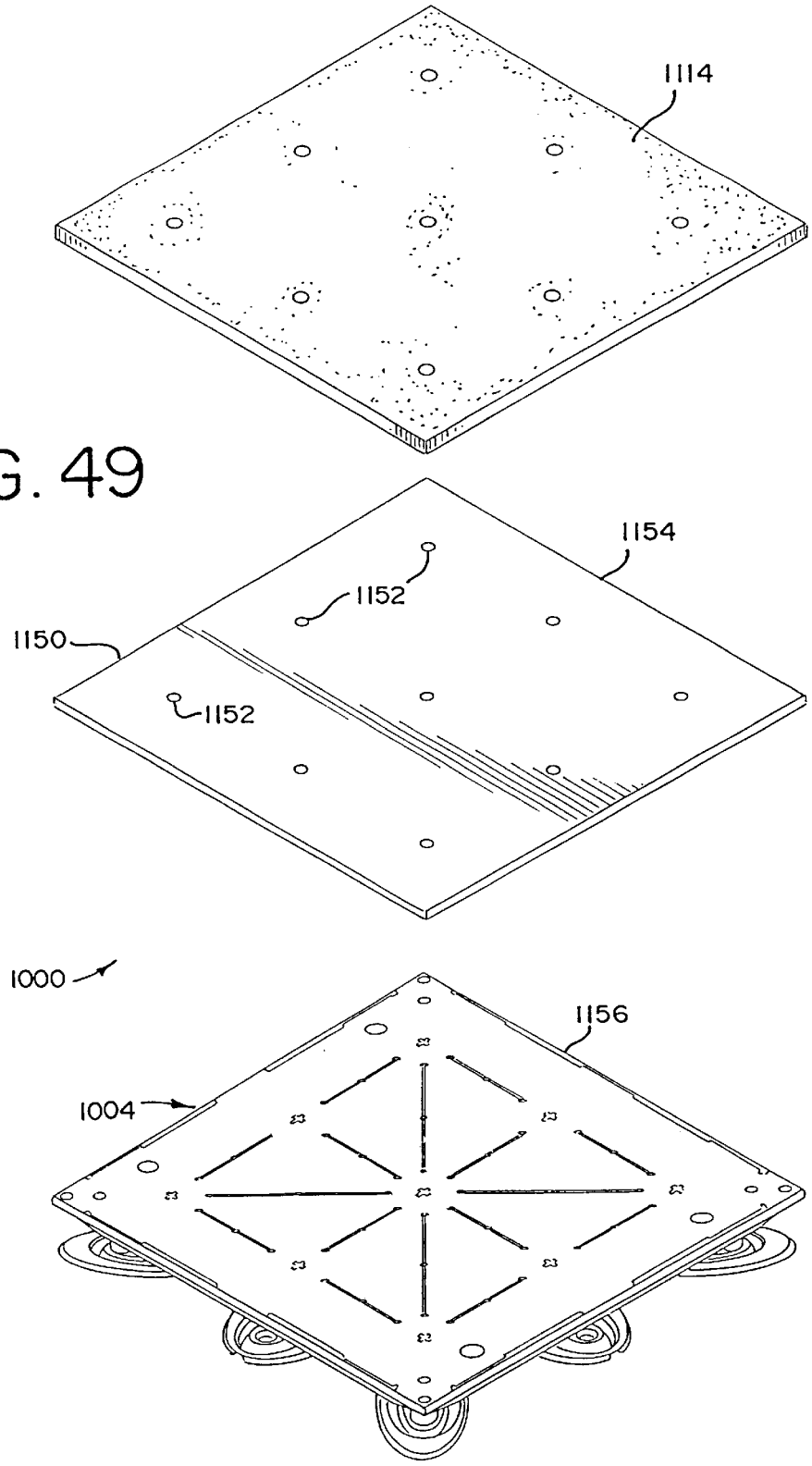
FIG. 49 is an exploded view of another of a modular tile embodiment incorporating the use of a seal between the carpet tile and the cover.

FIG. 49 illustrates a modular tile 1000 having a seal 1150 between the carpet tile 1114 and the cover 1004. The seal 1150, preferably formed from plastic, includes apertures 1152 corresponding with the apertures in the carpet tile 1114 and the cover 1004. The seal 1150 includes a periphery 1154 that extends over and slightly out from a lip 11565 on the cover 1004. The periphery 1154 extends and overlaps the periphery of an adjacent seal 1150. The periphery 1154 of the seal 1150 prevents dirt and other elements such as moisture from passing between adjacent covers 1004.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims including all equivalents thereof, which are intended to define the scope of the invention.

We claim:

1. A modular tile for installation on top of an existing floor, the modular tile comprising:

a base structure having a generally horizontal portion, the base structure comprising four connecting points such that a plurality of the base structures placed on top of the existing floor and arranged so that a corner of each adjacent base structure meet at a common point can be releasably affixed to one another by way of a modular tile connect, floor support members positioned on a bottom surface of the generally horizontal portion, and upper column members extending above the horizontal portion, and a cover supported by the upper column members a distance above the horizontal portion thereby creating a chamber between the horizontal portion and the cover, the chamber adapted to receive cabling therein.

2. The invention of claim 1 wherein the cover comprises a floor covering material.

3. The invention of claim 2 wherein the floor covering material is carpet.

4. The invention of claim 1 wherein the four connecting points are located at the four corners of the base structure.

5. The invention of claim 4 wherein a resilient member is located on the connecting points.

6. The invention of claim 5 wherein the base structure further comprises a hole through the generally horizontal portion such that cabling can pass between a lower chamber and an upper chamber.

7. The invention of claim 6 wherein the modular tile further comprises a nonmetallic cover positioned between the base structure and the cover.

8. The invention of claim 7 wherein the base structure has a bottom surface having a floor support element.

9. The invention of claim 8 wherein the floor support members form an oval shaped ridge.

10. The invention of claim 9 wherein the base structure is a one piece construction.

11. A system of modular tiles for installation on top of an existing floor, comprising:

at least four generally rectangular modular tiles arranged so that a corner of each of the modular tiles meets at a common point, each modular tile comprising a generally rectangular base structure, the base structure having a generally horizontal portion, a connecting point at each corner, upper column members extending above the horizontal base structure portion, a cover supported by the upper column members thereby creating a chamber between the horizontal portion and the cover adapted to receive cabling therein; and a modular tile connect engaging adjacent connecting points of the modular tiles to releasably connect the modular tiles.

12. The invention of claim 11 wherein the modular tile connect comprises a central member and four connecting members extending therefrom.

13. The invention of claim 12 wherein each connecting member comprises a pin and wherein each connecting point is a hole adapted to receive the pin.

14. The invention of claim 13 further comprising a modular tile platform ramp connected to one of the modular tiles.

15. The invention of claim 13 further comprising a seal mounted over the upper column members.

16. The invention of claim 15 wherein the seal includes a cut adapted to receive a probe extending downward from the cover.

17. A system of modular tiles for installation on top of an existing floor and on which a work environment is configured, the work environment comprising elements selected from a group comprising panels, screens, work surfaces, storage cabinets, and lamps, the system comprising a plurality of modular tiles arranged side by side across the existing floor to thereby create a work environment platform, each modular tile comprising a bottom portion and a top portion, the top portion including an array of apertures, the array being generally identical on each modular tile, the apertures adapted to receive a protruding portion of an indexing element associated with at least some of the work environment elements, the indexing element extending downward into an upper column attached to a horizontal base portion.

18. The invention of claim 17, wherein the array of apertures on each modular tile is configured so as to provide an array on the work environment platform of equally spaced columns and rows of apertures.

19. The invention of claim 18, wherein each modular tile includes 9 apertures in three rows and three columns.

20. The invention of claim 19, wherein the apertures are star shaped.

* * * * *